United States Patent [19]

Kobori et al.

[11] Patent Number: 5,036,633

[45] Date of Patent: Aug. 6, 1991

[54] VARIABLE DAMPING AND STIFFNESS STRUCTURE

[75] Inventors: Takuji Kobori; Motoichi Takahashi; Tadashi Nasu; Naoki Niwa; Narito Kurata; Junichi Hirai; Yoshinori Adachi; Koji Ishii, all of Tokyo, Japan

[73] Assignee: Kajima Corporation, Tokyo, Japan

[21] Appl. No.: 475,818

[22] Filed: Feb. 6, 1990

[30] Foreign Application Priority Data

| | | | |
|---|---|---|---|
| Feb. 7, 1989 | [JP] | Japan | 1-27901 |
| Feb. 7, 1989 | [JP] | Japan | 1-27902 |
| Feb. 7, 1989 | [JP] | Japan | 1-27903 |
| Feb. 7, 1989 | [JP] | Japan | 1-27904 |
| Feb. 23, 1989 | [JP] | Japan | 1-43565 |
| Mar. 14, 1989 | [JP] | Japan | 1-61237 |
| Mar. 23, 1989 | [JP] | Japan | 1-71182 |

[51] Int. Cl.[5] ..... E04A 9/00

[52] U.S. Cl. ..... 52/1; 52/167 DF

[58] Field of Search ..... 52/1, 167 DF

[56] References Cited

U.S. PATENT DOCUMENTS

| | | | |
|---|---|---|---|
| 4,429,496 | 2/1984 | Masri | 52/1 |
| 4,587,773 | 5/1986 | Valencia | 52/167 DF |
| 4,799,339 | 1/1989 | Kobori et al. | 52/1 |
| 4,841,685 | 6/1989 | Masri et al. | 52/1 |
| 4,890,430 | 1/1990 | Kobori et al. . | |
| 4,901,486 | 2/1990 | Kobori et al. . | |
| 4,922,667 | 5/1990 | Kobori et al. . | |
| 4,959,934 | 10/1990 | Yamada et al. . | |

*Primary Examiner*—David A. Scherbel
*Assistant Examiner*—Creighton Smith
*Attorney, Agent, or Firm*—James H. Tilberry

[57] ABSTRACT

A variable damping and stiffness structure is disclosed, which includes a variable damping device provided between posts, beams and braces of a structure or braces serving as variable stiffness elements and interconnecting a frame body and the variable stiffness element or the variable stiffness elements themselves. Not only the unreasonance property, but also the damping property of the structure are compositely judged by a computer on the basis of information obtained from sensors with respect to disturbances such as earthquake and wind to control the connecting condition of the variable damping device, whereby both the unresonance property and the damping property are controlled to reduce the response amount of the structure. Otherwise, the variable damping device is controlled by the judgement of only the damping property.

20 Claims, 13 Drawing Sheets

VARIABLE DAMPING AND STIFFNESS STRUCTURE

BACKGROUND OF THE INVENTION

1. Field of the Invention

This invention relates to a variable damping and stiffness structure having a variable damping device provided in a frame of the structure and interconnecting a frame body and a variable stiffness element or variable stiffness elements themselves provided in the frame, wherein an external vibrational force or disturbance like an earthquake and wind is controlled by a computer according to the vibration of the structure to thereby reduce the response amount of the structure.

2. Description of the Prior Art

The present applicant has proposed various active seismic response control systems and variable stiffness structures (for example, Japanese Patent Laid-open No. Sho 62-268479 and U.S. Pat. No. 4,799,339), in which a variable stiffness element in the form of a brace and a wall or the like is incorporated into a post-beam frame of the structure, and the stiffness of the variable stiffness element itself or the connecting condition of a frame body and the variable stiffness element is varied to analyze the property of an external vibrational force like an earthquake and wind by a computer, so that the stiffness of the structure is varied to provide unresonance with the external vibrational force to achieve the safety of the structure.

Now, conventional active seismic response control systems observe mainly the relationship between a predominant period of the seismic motion or the like and a natural frequency (usually, the primary natural frequency is often taken into consideration) of a structure, wherein a resonance phenomenon is avoided by offsetting actively the natural frequency of the structure relative to the predominant period to thereby improve the reduction in the response amount.

However, since the seismic motion or the like is particularly non-stationary vibrations, it is conceivable that the conventional active seismic response control system does not necessarily carry out the optimal control in the case where the predominant period is indistinct or a plurality of predominant periods are present, for example.

SUMMARY OF THE INVENTION

While the conventional active seismic response control system mainly observes the unresonance property, the present invention provides a variable damping device between a frame body and a variable stiffness element or in the variable stiffness element to control the damping coefficient, whereby the vibration is controlled in consideration of the damping property.

Namely, a variable damping and stiffness structure according to the present invention is so constituted that a variable damping device capable of varying the damping coefficient on two or multiple steps is interposed between the frame body of the structure and the variable stiffness element or in the frame body, and the damping corresponding to the vibration of the frame body is obtained by a computer to vary actively the damping coefficient of the variable damping device giving the damping, so that the response of the structure to an external vibrational force is reduced.

While the variable damping device serves as a variable stiffness device for varying the stiffness of the frame body as long as the variable damping device controls only locked condition and the freed condition, for example, the various damping coefficients are given by adjusting delicately the connecting condition between the completely locked condition and the completely freed condition to provide the natural period of the frame body according to the damping coefficient and the vibrational condition of the frame body.

As the variable damping device capable of varying two kinds of damping coefficients $C_1$, $C_2$, a connecting device (hereinafter referred to as a cylinder lock device), in which a cylinder is connected to the variable stiffness element like a brace, and a piston rod of a double-rod type reciprocating in the cylinder is connected to the frame body, is conceivable. As shown in FIG. 3, the cylinder lock device has a switch valve 15 provided in an oil path 14 interconnecting a pair of oil pressure chambers 13 respectively located on both sides of the piston 12*a*, wherein the variable damping device is controlled either to the free side first condition or the locked side second condition by the opening or closing operation of the switch valve 15. The oil path 14 is provided with an orifice 16, whereby first damping coefficient $C_1$ in the first condition is realized by designing the size of the orifice. Referring to a second damping coefficient $C_2$, a second oil path 17 is provided as a bypass for the switch valve 15, and an orifice 18 is provided also in the second oil path 17, whereby the second damping coefficient $C_2$ in the second condition is realized by designing the size of the orifice 18. The same may be said of a cylinder lock device of another type, in which a cylinder 11 is connected to the frame body and a piston rod 12 is connected to the variable stiffness element.

In the cylinder lock device 10 utilizing the oil pressure, a damping force for the frame body is given as a resistance force proportional to the power of the relative speed of the piston rod 12 to the cylinder 11. The frame characteristics in this case are shown in FIGS. 4 and 5, in which the solid line represents the frame characteristics in large amplitude and the broken line represents the frame characteristics in small amplitude. That is, the frame using the cylinder lock device shows different characteristics depending on the magnitude of vibration (for example, amplitude). Graphs shown in FIGS. 4 and 5 show the frame characteristics in two kinds of vibrational levels ($\pm 0.5$ cm and $\pm 3.0$ cm in amplitude between stories), and the natural period of the frame varies in a value of the damping coefficient C (damping coefficient $C_{01}$, of which the damping factor h reaches the maximum at the large vibration level, and damping coefficient $C_{02}$, of which the damping factor h reaches the maximum at the small vibration level) of the cylinder lock device, in which the damping factor h of the frame reaches the maximum.

Assuming that the damping coefficient in the upper limit of the vibration level to be controlled is equal with $C_{01}$ of the above-mentioned damping coefficient and the damping coefficient in the lower limit of the vibration level to be controlled is equal with $C_{02}$ of the above-mentioned damping coefficient, and when the period in such the range is always variable, as is apparent from FIG. 4, the first and second damping coefficients $C_1$, $C_2$ will do if these coefficients $C_1$, $C_2$ are defined respectively as follows;

$$C_1 < C_{01},\ C_2 > C_{02} \qquad (1)$$

Also, as is apparent from FIG. 5, these coefficients $C_1$, $C_2$ are preferably defined as values not so much deviated from $C_{01}$, $C_{02}$ respectively.

Table-1 shows examples of the damping factor h and the primary natural period of the frame relative to two kinds of defined damping coefficients $C_1$, $C_2$.

TABLE-1

| damping coefficient | magnitude of vibration | h (%) | T (sec) |
|---|---|---|---|
| $C_1$ | small | 10 | 1.0 |
| | large | 25 | 1.0 |
| $C_2$ | small | 30 | 0.4 |
| | large | 10 | 0.4 |

Provided that the selection of $C_1$, $C_2$ varies with the range of the vibration level to be controlled and in the case where a range capable of varying the period may be limited, $C_1$, $C_2$ are not necessarily limited to the range represented in (1).

Further, the variable damping device for giving two kinds of damping coefficients is not limited to the above-mentioned cylinder lock device, but any other variable damping device will do so long as it is capable of setting at least two kinds of damping coefficients to provide a damping force proportional to the power of the relative speed.

The active seismic response control system in this case is constituted of the variable damping device interposed between the frame body and the variable stiffness element or in the variable stiffness element and setting at least two kinds of damping coefficients $C_1$, $C_2$ as noted above, frequency characteristic analyzing means, response amount measuring means, damping coefficient selecting means and control command generating means.

The external vibrational force input to a structure is sensed by a sensor or the like installed in the structure or in the outside, and the predominant period and other frequency characteristics are analyzed by the frequency characteristic analyzing means in a computer program. The actual response amount of the structure or that of the frame body is sensed by an accelerometer, a speedometer, a displacement meter or like sensors serving as the response amount measuring means. The unresonance property and the damping property of the frame body are estimated and compositely examined with reference to these frequency characteristics and the response amount by the damping coefficient selecting means in a computer program, whereby either of two kinds of the damping coefficients $C_1$, $C_2$ is selected as the damping coefficient for reducing the response of the structure. That is, case where the predominant period is indistinct and the unresonance is impossible or the case where the damping control effect is larger than the unresonance effect according to the distribution of a period component such as the seismic motion is judged by the computer on the basis of the obtained frequency characteristics and response amount to select the damping coefficient. Further, the natural period of the frame body or that of the structure results in either a long or short period according to the vibration level by selecting the damping coefficient. Thus, the natural period for the unresonance is selected by selecting the damping coefficient according to the vibration level. The selected damping coefficient is realized by giving the control command generated from the control command generating means to the variable damping device.

As the cylinder lock device capable of varying the damping coefficient on multiple stages or continuously, a cylinder lock device, in which a cylinder is connected to the variable stiffness element such as a brace and a piston rod of a double-rod type reciprocating in the cylinder is connected to the frame body, for example is conceivable. As shown in FIG. 15, the cylinder lock device includes an orifice 35 capable of varying the opening and provided in an oil path 34 interconnecting a pair of oil pressure chambers 33 respectively located on both sides of a piston 32*a*, whereby the damping coefficients ranging from the small damping coefficient at the freed side having the large opening to the large damping coefficient at the locked side having the small opening are adjusted on multiple stages or continuously by adjusting the opening of the orifice. As the orifice 35, use is particularly made of a high speed switch valve or the like controlled in response to a pulse signal through a pulse generator or the like. As shown in FIG. 16, the various openings and the various damping coefficients accompanying the change in the opening are realized by varying a valve opening time. The time, during which the valves are closed in the order from above to below in FIG. 16 is elongated and the dimensional relationship among the damping coefficients $C_1$, $C_2$, $C_3$ under the respective conditions is as follows:

$$C_1 < C_2 < C_3$$

Otherwise, the opening may be adjusted by any mechanical constitution.

The same may be said of a cylinder lock device of another type, in which a cylinder 31 is connected to the frame body and a piston rod 32 is connected to the variable stiffness element.

In the cylinder lock device 30 utilizing the oil pressure, the damping force for the frame body is given as a resistance force ($P=cv^r$) proportional to the power of the relative speed of the piston rod 32 to the cylinder 31, and the frame body shows the characteristics varying with the magnitude of vibration (for example, amplitude).

The frame characteristics in this case are as shown in FIGS. 17 and 18.

That is, the frame using the cylinder lock device shows the characteristics varying with the magnitude of vibration (for example, amplitude). Graphs shown in FIGS. 17 and 18 show the frame characteristics in five kinds of vibration levels ranging from the large vibration of about several cms of story amplitude to the small vibration of about several mms of story amplitude. In the vicinity of values $C_1$, $C_2$, $C_3$, $C_4$ and $C_5$ of the damping coefficient in which the damping factor h of the frame in each vibration level reaches the maximum, the natural period (primary natural period) of the frame is varied from the long natural period $T_1$ to the short natural period $T_2$. Also, as is apparent from these graphs, the larger the vibration is, the smaller the damping coefficient of the variable damping device producing the maximum damping effect is.

Referring to the control observing only the damping property, the response of the structure is reduced by adjusting the damping coefficient of the variable damping device according to the vibration level of the frame such that the damping effect of the frame is maximized by utilizing the frame characteristics.

The active seismic response control system in this case is constituted of the variable damping device interposed between the frame body and the variable stiffness element or in the variable stiffness element and capable of varying the damping coefficient as noted above, response amount measuring means, damping coefficient selecting means and control command generating means.

When the external vibrational force is input to the structure, the response amount of the structure or that of the frame body is sensed by an accelerometer, a speedometer, a displacement meter or like sensors serving as the response amount measuring means. A large damping property is given to the structure according to the vibration level by the damping coefficient selecting means in the computer program to select a value of the optional damping coefficient C for reducing the response of the structure. The selected value of the damping coefficient C is realized by giving the control command to the variable damping device from the control command generating means, that is, by adjusting the opening of the switch valve of the variable damping device.

Also, in the control in consideration of both damping property and unresonance property, assuming that the damping coefficient for maximizing the damping factor h of the frame is $C_i$ in a certain vibration level, as is apparent from FIG. 17, the damping coefficient $C_{i1}=C_i-a(a>0)$ which is somewhat smaller than the damping coefficient $C_i$ results in the longer natural period $T_1$ of the frame and the damping coefficient $C_{i2}=C_i-b(b>0)$ which is somewhat larger than the damping coefficient $C_i$ results in the shorter natural period $T_2$ of the frame. With reference to FIG. 18 showing the relationship between the damping coefficient C of the variable damping device and the damping factor h of the frame, either of the natural period $T_1$, or $T_2$, which is advantageous for the frame in the facet of the unresonance property, is realized, and the response of the structure is reduced in both facets of unresonance and damping effect by selecting (defining a or b as small as possible in an extent of satisfying the requirements of the natural period) such damping coefficient to make the damping effect of the frame large as much as possible. When the effect on unresonance property cannot be so much expected, for example, in the case where the predominant period of the seismic motion is indistinct, however, the large damping effect can be expected by selecting the damping coefficient $C_i$ maximizing the damping factor h of the frame for the damping coefficient of the variable damping device.

Further, the variable damping device providing the damping coefficients on multiple stages or continuously is not limited to cylinder lock device, but any other variable damping device will do as long as it gives the damping force proportional to the power of the relative speed.

The active seismic response control system in this case is constituted of the variable damping device interposed between the frame body and the variable stiffness element or in the variable stiffness element and capable of varying the damping coefficient as noted above, frequency characteristic analyzing means, response amount measuring means, unresonance property estimating means, damping property estimating means, damping coefficient selecting means and control command generating means.

The external vibrational force input to the structure is sensed by sensors installed in the structure or in the outside thereof, and the predominant period and other frequency characteristics are analyzed by the frequency characteristic analyzing means in the computer program. On the other hand, the actual response amount of the structure or that of the frame body is sensed by an accelerometer, a speedometer, a displacement meter or like sensors serving as the response amount measuring means, and the unresonance property and the damping property of the frame body are estimated by the unresonance property estimating means and the damping property estimating means in the computer program with respect to the frequency characteristic and the response amount, so that the damping coefficient for reducing effectively the response of the structure is selected by judging compositely the unresonance property and the damping property of the frame body. For example, the unresonance property is estimated with respect to two kinds of natural periods $T_1$, $T_2$ given to the frame body by the variable damping device, and when the effect on the unresonance property due to either natural period is judged to be larger, the damping coefficient for realizing the natural period selected in an extent of giving the damping property as large as possible in the response amount, i.e., the vibration level is selected. If the predominant period is indistinct and the unresonance cannot be provided, for example, only the damping property is contemplated to select the damping coefficient giving the maximum damping to the structure. The selected damping coefficient is realized by giving the control command generated from the control command generating means to the variable damping device.

OBJECT OF THE INVENTION

A primary object of the present invention is to reduce the response amount of a structure by varying the damping coefficient of a connecting device interposed between a frame body and a variable stiffness element to compositely estimate and control the resonance property and the damping property of the structure, whereby the safety of the structure is ensured, while a comfortable residential space is realized.

Another object of the present invention is to reduce the response amount of a structure by previously grasping the frame characteristics such as the relationship between the vibration level and the damping coefficient in order to control the disturbance such as a seismic motion in consideration of the damping property of the structure, and then controlling the damping property corresponding to the response amount of the structure. Namely, the damping coefficient of the variable damping device is varied to vary the connecting condition of the variable stiffness element and the variable damping device, and the optimal damping property corresponding to the characteristics of the structure is provided to reduce the response amount of the structure, whereby the safety of the structure is ensured, while the comfortable residential space is realized.

A further object of the present invention is to perform the more rational control by judging the resonance property and the damping property at the same time to compositely estimate and control the resonance property and the damping property of the structure for the input disturbance and the response of the structure.

A still further object of the present invention is to more rationally control the response of a structure by performing the control in consideration of not only the unresonance property but also the damping property of the structure for the disturbance such as a seismic motion, even when the effect on reduction of the vibration due to the unresonance in little.

A yet further object of the present invention is to provide a variable damping device suitably used for controlling the vibration of a structure by estimating the resonance property and the damping property.

DETAILED DESCRIPTION OF PREFERRED EMBODIMENTS

First will be described an embodiment of a control system used for a variable damping and stiffness structure according to the present invention.

Active seismic response control system 1

In this system, a variable damping device having two kinds of specified damping coefficients $C_1$, $C_2$ set is interposed between a frame body and a variable stiffness element or in the variable stiffness element, and the unresonance property and damping property are compositely judged to control the vibration of a structure by varying the connecting condition of the variable damping device.

Figure 1:
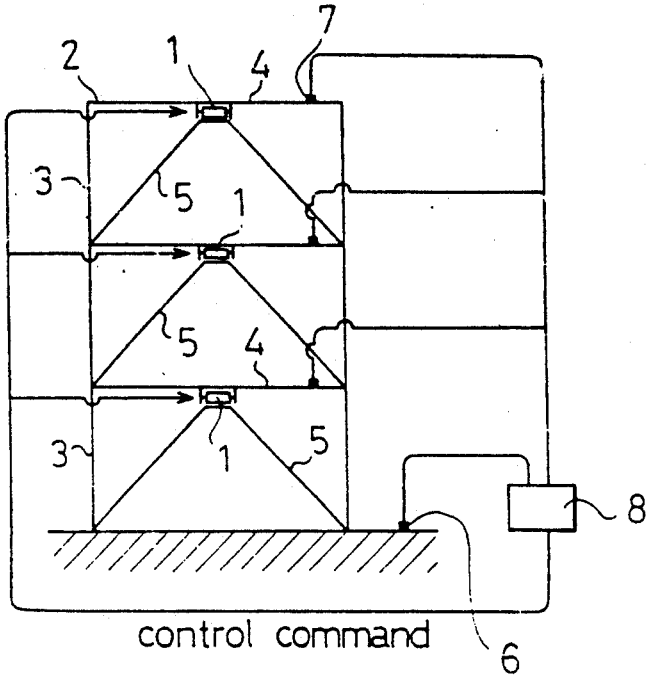
FIG. 1 is a schematic view showing a variable damping and stiffness structure, to which a first active seismic response control system is applied according to the present invention.
Figure 2:
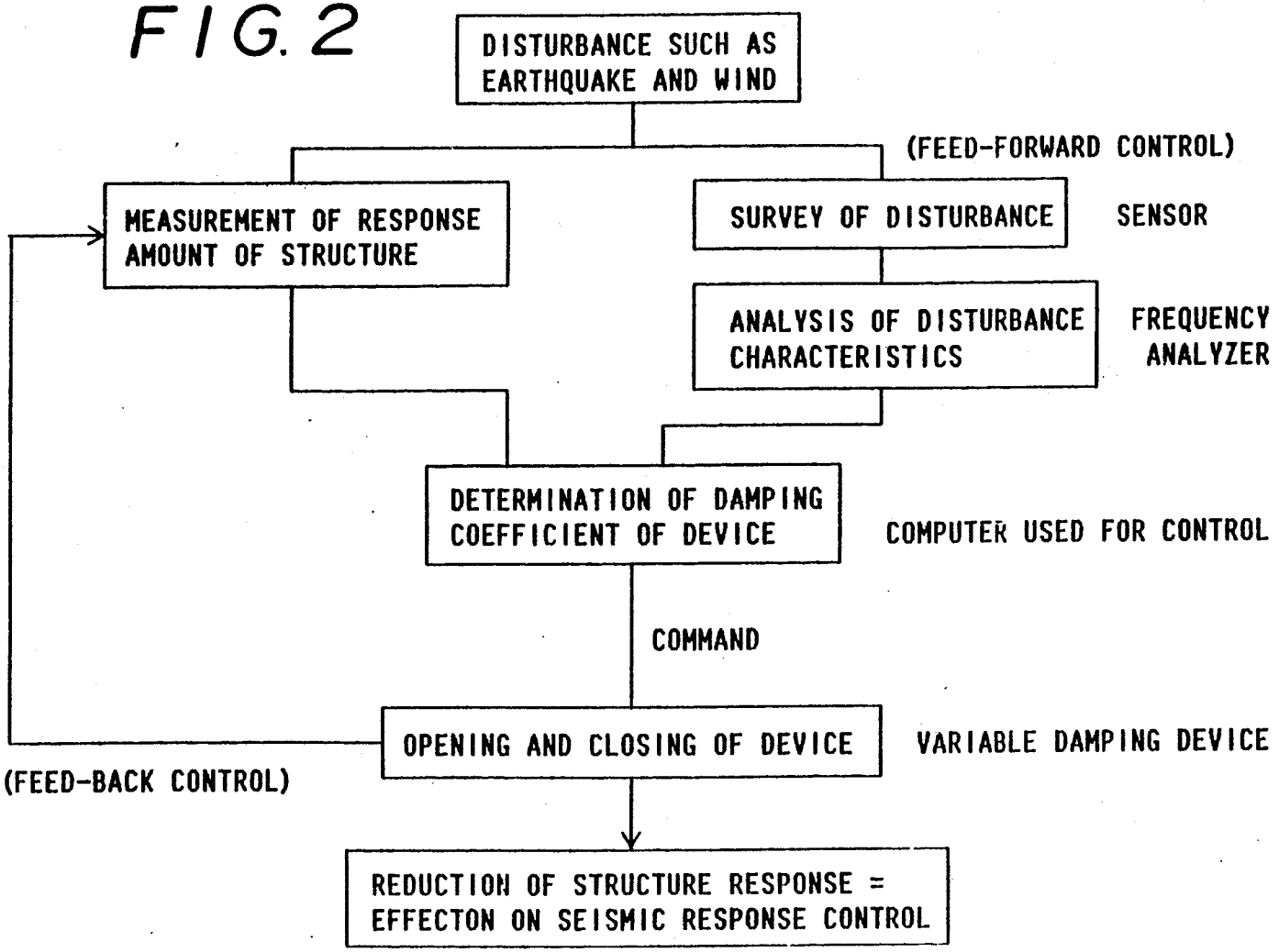
FIG. 2 is a chart of control in accordance with the first active seismic response control system.

FIG. 1 shows the outline of the constitution of the active seismic response control system according to the present invention. A variable damping device 1 (for example, the cylinder lock device as noted above) is interposed between a frame body 2 composed of posts 3 and beams 4 and an inverted V-shaped brace 5 provided as a variable stiffness element and incorporated in the frame body 2 of each story. The input seismic motion and the response (amplitude, speed, acceleration or the like) of a structure thereto are respectively sensed by an input sensor 6 and a response sensor 7, and the damping coefficient of the variable damping device 1 corresponding to the seismic motion characteristics (predominant period) and the response condition is obtained by a computer 8 to output a control command. FIG. 2 shows the flow of the process in the above control.

More particularly, the control is carried out as follows;

(1) A vibration level for the control is set. For example, ±0.5 to ±3.0 cm of story deformation amount, and 1 to 25 kine (cm/sec) of speed or the like.

(2) The frame characteristics in the upper and lower limits of the set vibration level is grasped. For example, the variation of period and damping factor of the frame body due to the damping coefficient of the variable damping device or the like.

(3) The period shall be able to surely vary in the set vibration level, and further the damping coefficient $C_1$, $C_2$ of the variable damping device capable of additionally producing the effect on damping to the frame as large as possible shall be selected so that either $C_1$ or $C_2$ is selected according to the control command.

(4) The damping property is estimated (feed-back control) according to the response of the structure, and the unresonance property is estimated (feed-forward control) according to the seismic motion characteristics (predominant period) so that the composite control becomes possible.

(5) In a small vibration (wind and small earthquake), the damping coefficient $C_2$ for producing the largest effect on damping in the small vibration level is normally selected.

Table-2 shows a summary of control manners in the seismic motion characteristics corresponding to FIGS. 6 through 12 as the embodiments of control. Further, in FIGS. 6 through 12, the ordinate represents response values, the abscissa represents periods, the solid line represents the response spectrum of a seismic motion, the dot-dash line represents the response value when the damping coefficient $C_1$ is selected, the broken line represents the response value when the damping coefficient $C_2$ is selected, the black circle represents the response value in the selected damping coefficient and the white circle represents the response value in the other damping coefficient not selected.

TABLE-2

Figure 6:
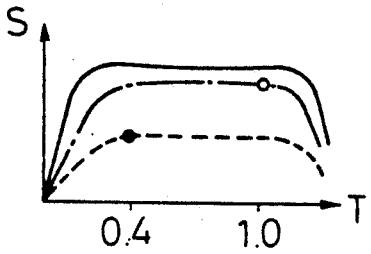
FIGS. 6 through 12 are graphs showing the relationship between the seismic motion characteristics of the control in accordance with the first active seismic response control system and the response amount in each of two kinds of damping coefficients, respectively.
Figure 7:
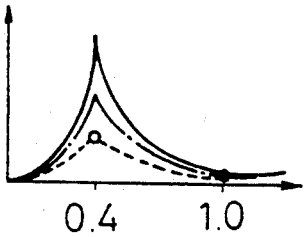
Figure 8:
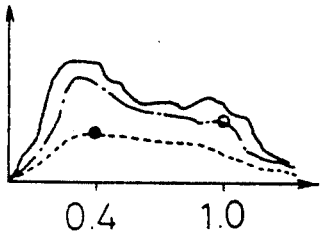
Figure 9:
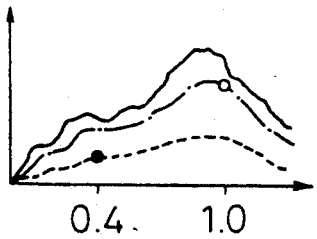
Figure 10:
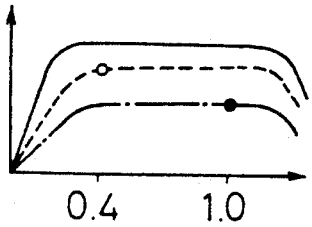
Figure 11:
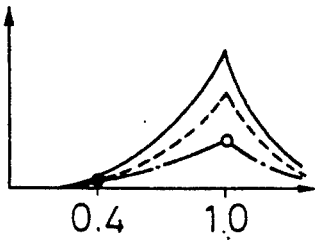
Figure 12:
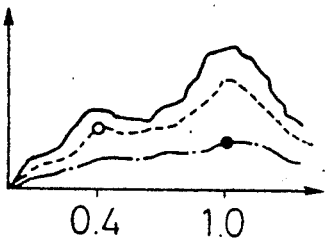

| Number | Vibration level | Seismic motion characteristics and others | Selected damping coefficient | Damping factor of frame, primary natural period and comments |
|---|---|---|---|---|
| 1 | small | FIG. 6 | $C_2$ | h = 30%, T = 0.4 sec<br>This case has the largest effect in damping. Unresonance is impossible |
| 2 | small | FIG. 7 | $C_1$ | h = 10%, T = 1.0 sec<br>This case is effective in unresonance more than damping |
| 3 | small | FIG. 8 | $C_2$ | h = 30%, T = 0.4 sec<br>This case is effective in damping more than unresonance |
| 4 | small | FIG. 9 | $C_2$ | h = 30%, T = 0.4 sec<br>This case has the effect both in damping and unresonance |
| 5 | large | FIG. 10 | $C_1$ | h = 25%, T = 1.0 sec<br>This case has the same effect as that in No. 1 |
| 6 | large | FIG. 11 | $C_2$ | h = 10%, T = 0.4 sec<br>This case has the same effect as that in No. 2 |
| 7 | large | FIG. 12 | $C_1$ | h = 25%, T = 1.0 sec<br>This case has the same effect as that in No. 4, while the damping coefficient is $C_1$. |

Active seismic response control system 2

Figure 13:
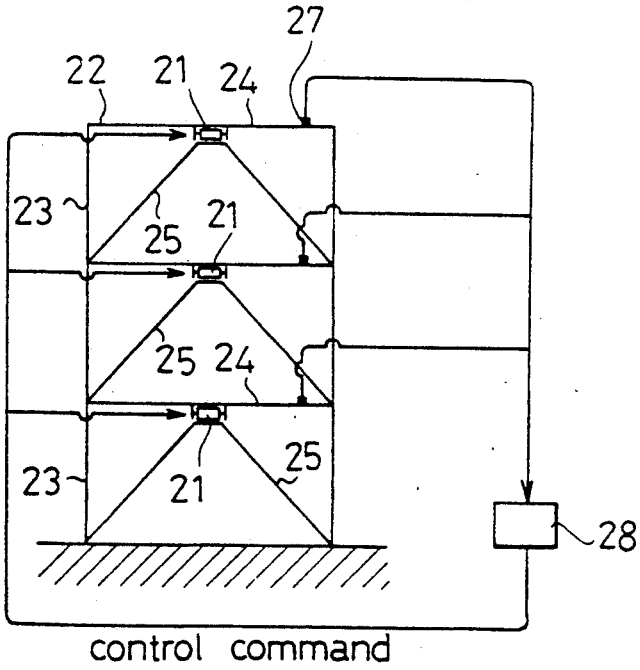
FIG. 13 is a schematic view showing a variable damping and stiffness structure, to which a second active seismic response control system is applied according to the invention.
Figure 14:
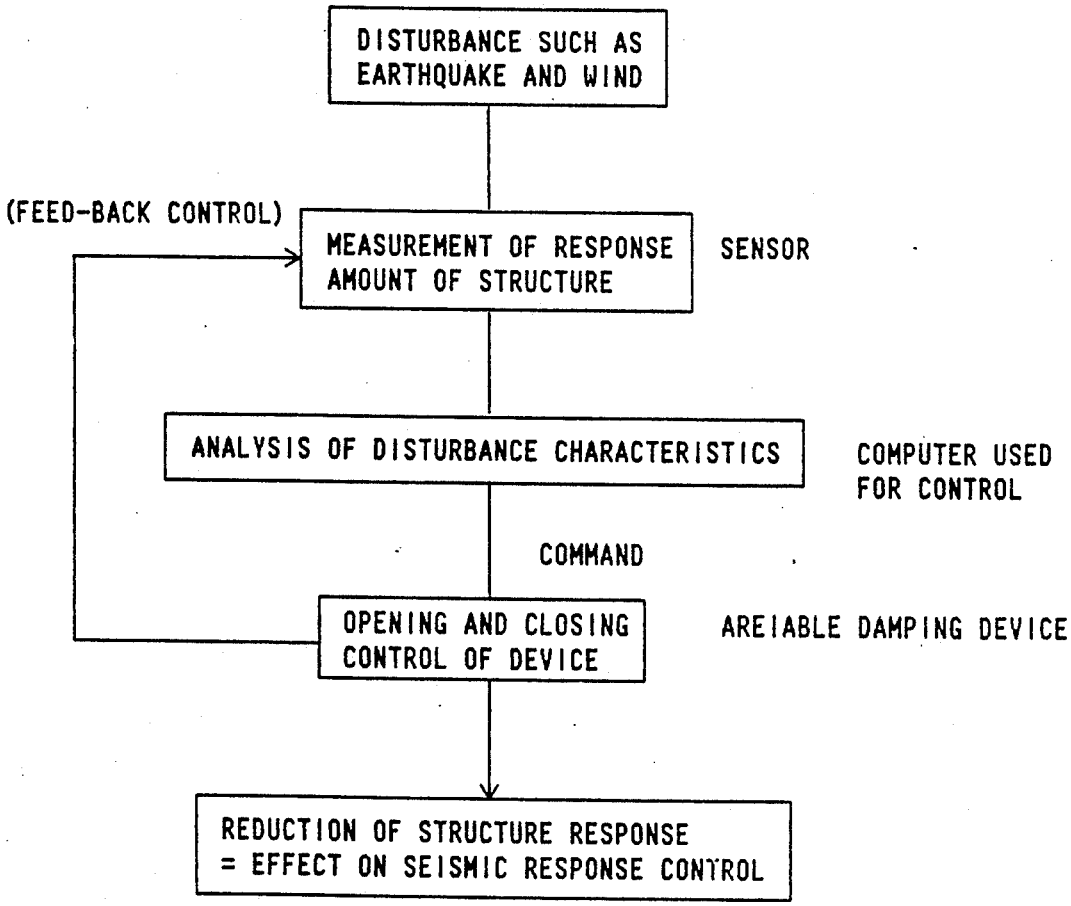
FIG. 14 is a flow chart of control in accordance with the second seismic response control system.

FIG. 13 shows the outline of a variable damping and stiffness structure in the system 2. A variable damping device 21 (for example, the cylinder lock device as noted above) is interposed between a frame body 22 composed of posts 23 and beams 24 and an inverted V-shaped brace 25 provided as a variable stiffness element and incorporated in the frame body 22 of each story. The response (amplitude, speed, acceleration or the like) of a structure in an earthquake is sensed by a response sensor 26 provided in the structure, and the optimal damping coefficient of the variable damping device 21 corresponding to the response condition, i.e., vibration level is obtained by a computer 28 to generate a control command. FIG. 14 shows the flow of the process in the above control.

Figure 15:
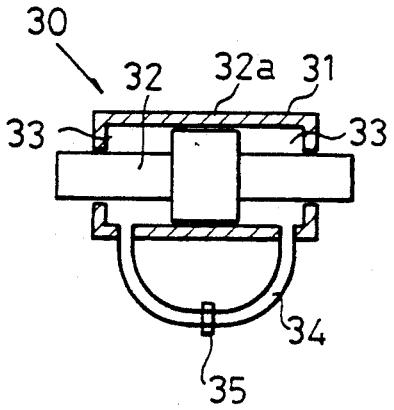
FIG. 15 is a conceptional view showing a cylinder lock device as an embodiment of a variable damping device used in the second and third active seismic response control systems.
Figure 18:
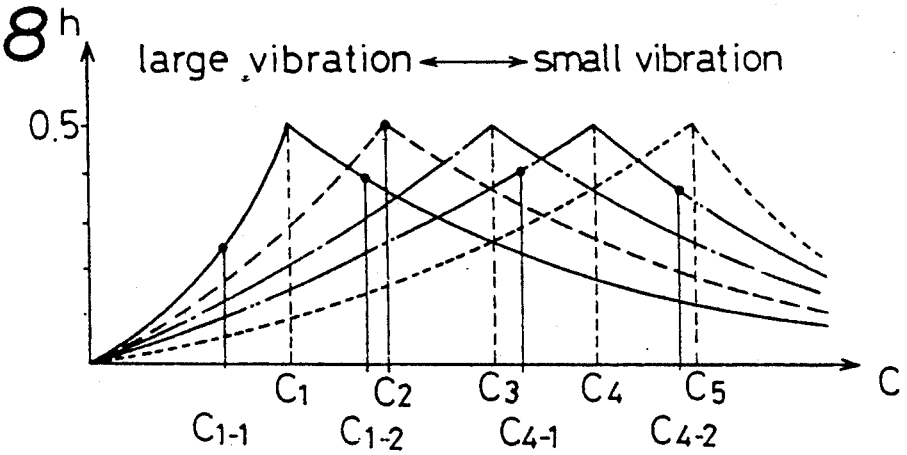

In a cylinder lock device 30 making use of oil pressure shown in FIG. 15 as noted above, a damping force relative to the frame body is given as a resistance force proportional to the power of the relative speed of a piston rod 32 to a cylinder 31. The frame characteristics in this case are as shown in FIG. 18. The graph in FIG. 18 shows the frame characteristics in five kinds of vibration levels ranging from the large vibration having about several cms of story amplitude to the small vibration having about several mms of story amplitude, in which reference numeral C represents the damping coefficient of the variable damping device and h represents the damping factor of the frame. As is apparent from this graph, the larger the vibration is, the smaller the damping coefficient C of the variable damping device producing the maximum effect on damping is.

In this embodiment, the damping coefficient of the variable damping device is adjusted according to the vibration level of the frame by making use of the frame characteristics such that the damping effect of the frame reaches the maximum, so that the response of the structure is reduced.

More particularly, the control is carried out as follows:

(1) First, the magnitude of vibration (amplitude, speed, acceleration or the like) of the structure, the damping coefficient C of the variable damping device and the damping effect h of the frame are grasped in relation to the control.

Figure 5:
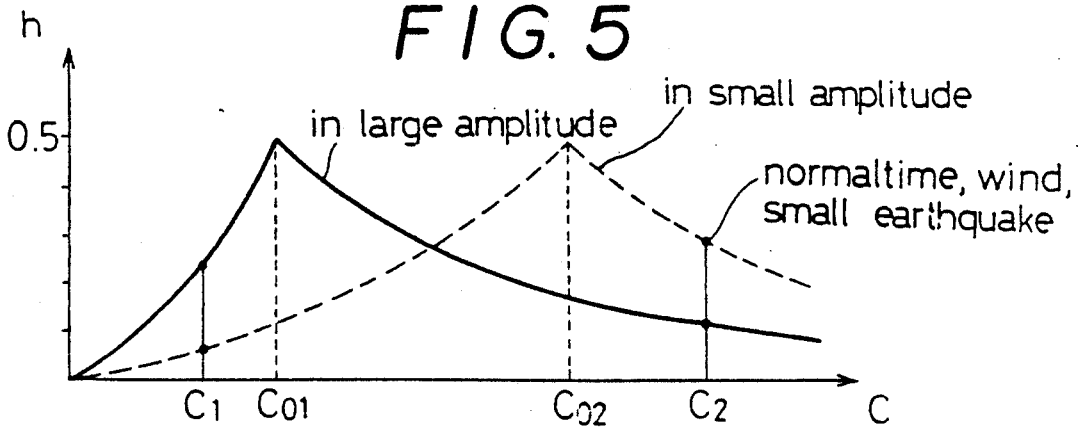

This corresponds to that the frame characteristics shown in FIG. 5 are grasped with respect to a plurality of vibration levels, for example and the damping coefficients $C_1, \ldots, C_n$ giving the maximum damping effect h of the corresponding structure or the frame are obtained with respect to the levels ranging from the large vibration level $L_1$ to the small vibration level $L_n$.

(2) The damping coefficient C minimizing the vibration of the structure is incessantly calculated by the computer on the basis of the above characteristics to control the variable damping device. This control results in the feed-back control since the variable damping device is controlled while the vibrational condition of the structure is monitored.

The control in the system 2 is thus fed back according to the response amount of the structure to be relatively simply carried out by previously grasping the relationship between the vibration level and the damping coefficient.

Active seismic response control system 3

Figure 19:
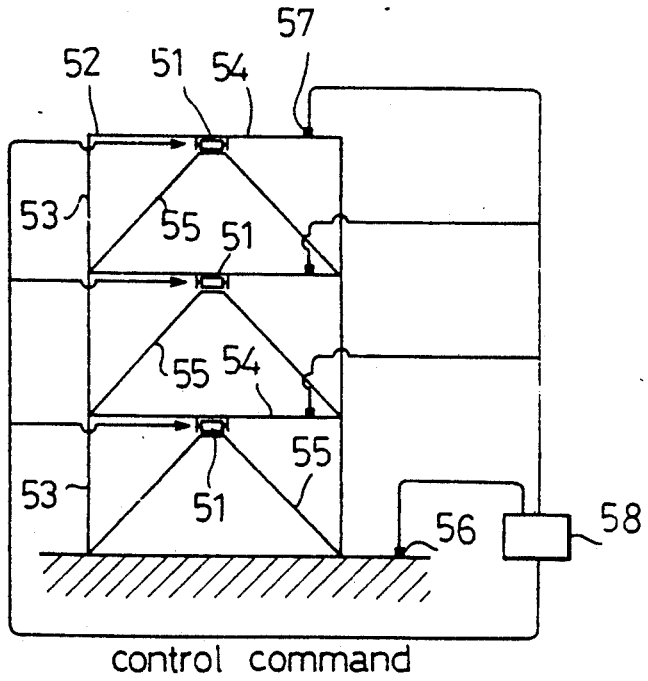
FIG. 19 is a schematic view showing a variable damping and stiffness structure, to which the third active seismic response control system according to the present invention is applied.
Figure 20:
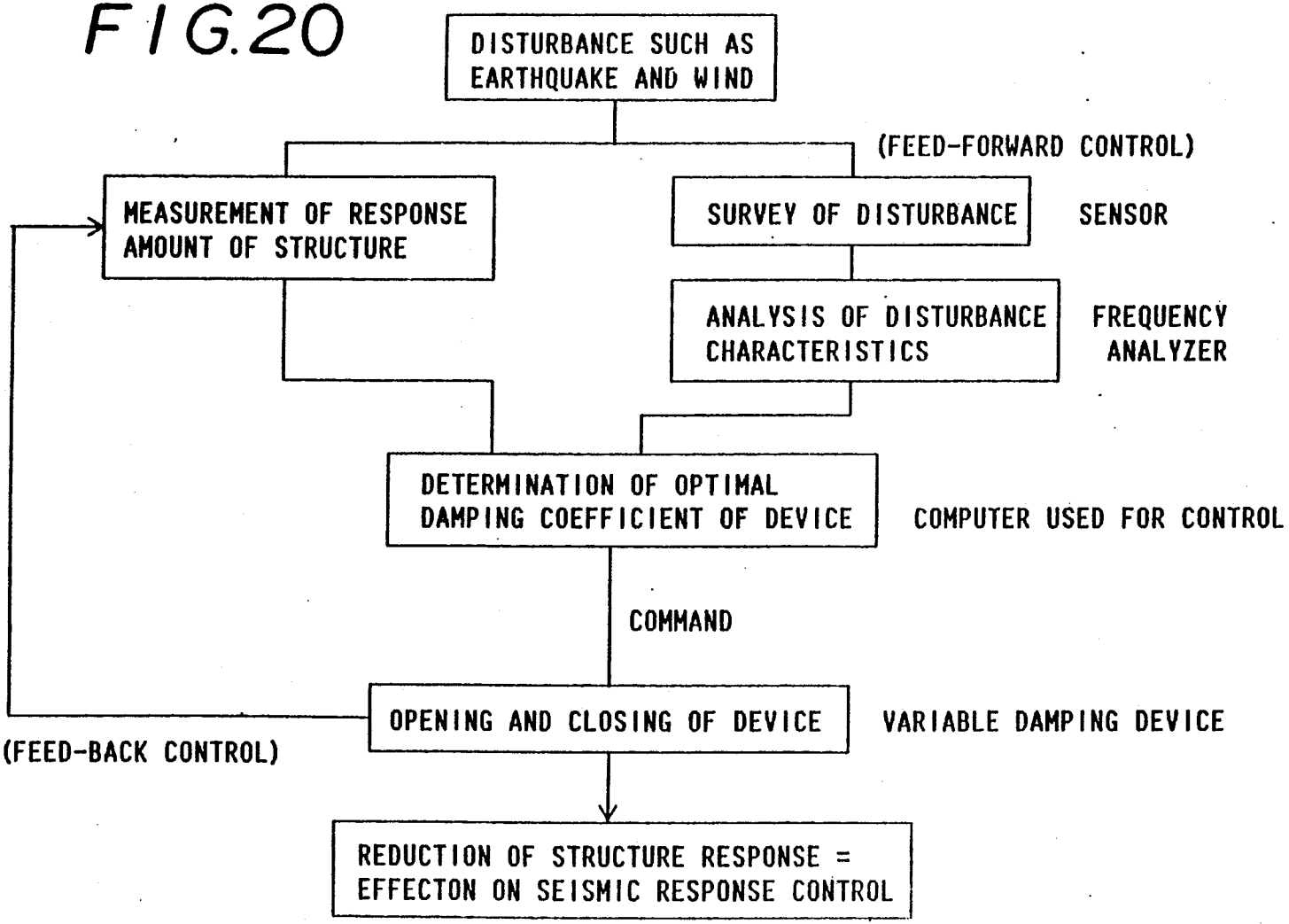
FIG. 20 is a flow chart of control in accordance with the third active seismic response control system.

FIG. 19 shows the outline of a variable damping and stiffness structure in the system 3. The input seismic motion and the response of the structure (amplitude, speed, acceleration) are sensed respectively by an input sensor 56 and a response sensor 57, and the damping coefficient of a variable damping device 51 according to the seismic motion characteristics (predominant period) and the response condition is obtained by a computer 58 to generate a control command. FIG. 20 shows the flow of the process in the above control.

The variable damping device 51 is as same as the variable damping device in the system 2. However, as is apparent from FIGS. 17 and 18, in respective vibration levels, the natural period (primary natural period) of the frame is also varied from the long natural period $T_1$ to the short natural period $T_2$ in the vicinity of values $C_1$, $C_2$, $C_3$, $C_4$ and $C_5$ of the damping coefficients maximizing the damping factor h of the frame.

Figure 17:
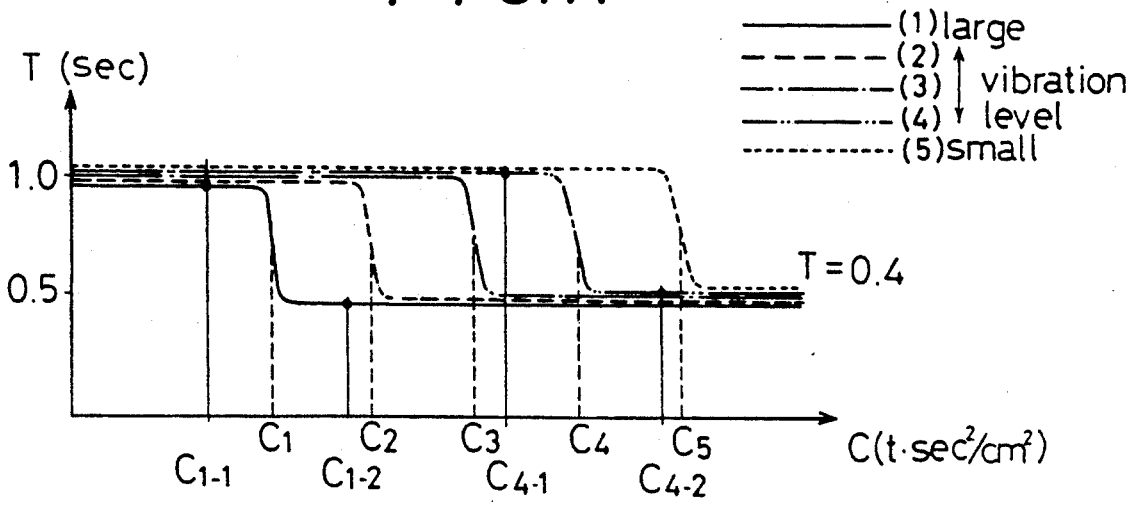
FIGS. 17 and 18 are graphs for explaining the frame characteristics of a structure, to which the second and third active seismic response control systems are applied, respectively.

Assuming that the damping coefficient maximizing the damping factor h of the frame in a certain vibration level is $C_1$ as above mentioned, the natural period of the frame results in the longer natural period $T_1$ in the damping coefficient $C_{i1}=C_i-a(a>0)$ which is somewhat smaller than the damping coefficient $C_i$ as shown in FIG. 17, while in the damping coefficient $C_{i2}=C_i-(b>0)$ which is somewhat larger than the damping coefficient $C_i$, the natural period of the frame results in the shorter period $T_2$. This is collated with FIG. 18 showing the relationship between the damping coefficient C of the variable damping device and the damping factor h of the frame. The natural period which is advantageous for the frame having either natural period $T_1$ or $T_2$ in the facet of unresonance property is realized, and the response of the structure is reduced in both facets of unresonance and damping effect by selecting such the damping coefficient to make the damping effect of the frame as large as possible (by taking the aforementioned a or b as small as possible within a range of satisfying the requirements of the natural period). However, when the predominant period of the seismic motion is indistinct and the effect on the unresonance properly is not so much expected, for example, a large damping effect is expected by selecting the damping coefficient $C_1$ maximizing the damping factor h of the frame as the damping coefficient of the variable damping device.

Hereinafter will be described this effect in relation to the flow chart shown in FIG. 20.

The external vibrational force input to the structure is detected by sensors provided in the structure or in the outside to analyze the predominant period and other frequency characteristics. On the other hand, the actual response amount of the structure of that of the frame body is detected by sensors such as an accelerometer, a speedometer and a displacement meter, and the unresonance property and the damping property of the frame body are estimated by the computer with reference to the frequency characteristics and the response amount to compositely judge the frequency characteristics and the response amount, so that the damping coefficient for reducing effectively the response of the structure is selected. For example, the unresonance property in two kinds of natural periods $T_1$, $T_2$ given to the frame body by the variable damping device is estimated. When the effect of the unresonance property due to either natural period is judged to be large, the damping coefficient for realizing the selected natural period is selected within the range of giving the damping property as large as possible in the response amount, i.e., vibration level at the time of the judgement. When the predominant period is indistinct, and the unresonance is not possible to be attained, for example, the damping coefficient giving the maximum damping to the structure is selected in consideration of only the damping property. The selected damping coefficient is realized by giving the control command from the control command generating means to the variable damping device.

More particularly, the control is carried out as follows;

(1) First, the magnitude (amplitude, speed, acceleration or the like) of the vibration of the structure, the damping coefficient C of the variable damping device, the damping effect h of the frame and the period T are grasped in relation to the control.

This, for example, corresponds to that the frame characteristics shown in FIGS. 17 and 18 are grasped in a plurality of vibration levels, and the damping coefficients $C_1, \ldots C_n$ giving the maximum damping factor h for the corresponding structure or the frame are obtained ranging from the large vibration level $L_1$ to the small vibration level $L_n$.

2) The damping coefficient C of the variable damping device is incessantly calculated by the computer such that the vibration of the structure is minimized on the basis of the characteristics to control the variable damping device.

(3) The damping coefficient C of the variable damping device is selected on the basis of the following three points:

i. The unresonance of the structure is realized against the seismic motion (feed-forward control). The damping coefficient C capable of realizing such the natural period to make the response of the structure smaller is selected on the basis of the frequency analysis of the seismic motion.

ii. The damping coefficient C giving the damping effect of the frame body as large as possible is selected according to the vibration condition of the structure (feed-back control), provided it is selected within the extent of realizing the natural period set in (i).

iii. When the effect due to the unresonance is little, the damping coefficient C maximizing the damping effect of the frame body is selected.

Table-3 summarizes the control in accordance with the system 3 corresponding to the frame characteristics shown in FIGS. 17 and 18.

TABLE-3

| magnitude of vibration | kind of line | seismic motion characteristics | optimal damping coefficient |
|---|---|---|---|
| large (1) | solid line | T = 0.4 | $C_{1-1}$ |
| | | T = 1.0 | $C_{1-2}$ |
| small (4) | two dots-chain line | T = 0.4 | $C_{4-1}$ |
| | | T = 1.0 | $C_{4-2}$ |
| medium (2) | dotted line | same | $C_2$ |

On Table-3, numerals in parenthesis in the column of the magnitude of vibration represent the vibration levels shown in FIGS. 17 and 18 in the order from the smaller level to the larger level, and the kind of lines indicates that in the drawings. Also, the seismic motion characteristics shown the natural period of smaller response spectrum out of two kinds of natural periods given by the variable damping device.

That is, on Table-3, when the vibration level is large (1) and the period component of 0.4 seconds is much for the seismic motion characteristics, the damping coefficient $C_{1-1}$ shown in FIGS. 17 and 18 is selected. When the period component of 1.0 second is much, the damping coefficient $C_{1-2}$ is selected. Similarly, when the vibration level is small (4) and the period component of 0.4 second is much for the seismic motion characteristics, the damping coefficient $C_{4-1}$ is selected, and when the period component of 1.0 second is much, the damping coefficient $C_{4-2}$ is selected. The lowermost row on Table-3 shows the case where there is little difference in the response spectrum between two kinds of natural periods, i.e., 0.4 secs and 1.0 sec of the frame. In this case, the damping coefficient $C_2$ giving the maximum damping property to the frame is selected.

Next will be described an embodiment of the variable damping device used in each of the active seismic response control systems 1 to 3.

Figure 21:
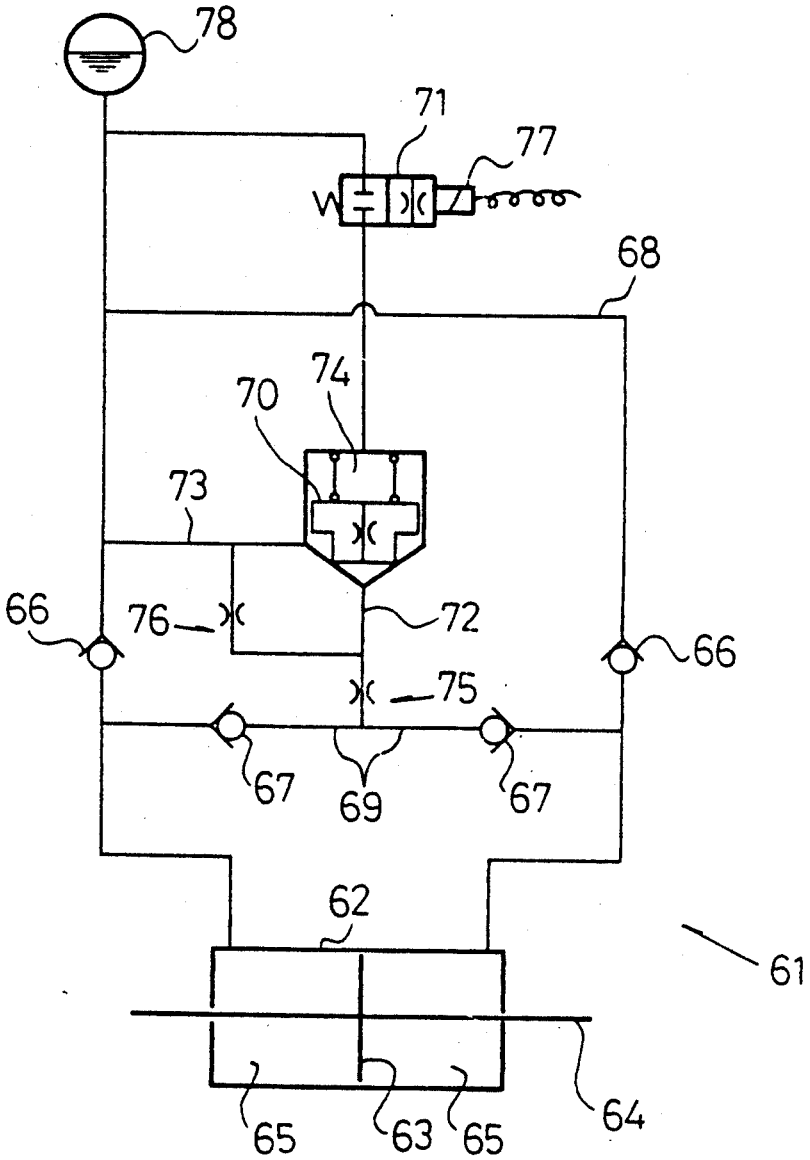
FIG. 21 is an oil pressure circuit diagram showing an embodiment of the cylinder lock device to be used in the first active seismic response control system.

FIG. 21 shows an embodiment of an oil pressure circuit of a variable damping device 61 used in the active seismic response control system 1. As shown in the drawing, a device body includes left and right oil pressure chambers 65 located at the left and right of a piston 63 of a double-rod type reciprocating in a cylinder 62. Pressurized oil in the left and right oil pressure chambers 65 is confined or adapted to flow by a change-over valve 70 used for large flow, so that the piston 63 is fixed or moved to the left and right.

One of the cylinder 62 and the rod 64 is connected to one of the frame body of the structure and the variable stiffness element of one of the variable stiffness elements themselves, and the other is connected to the other of the frame body and the variable stiffness element or the other of the variable stiffness elements themselves.

The left and right oil pressure chambers 65 are provided respectively with left and right outflow blocking check valves 66 for blocking the outflow of pressurized oil from the respective oil pressure chambers 65 and left and right inflow blocking check valves 67 for blocking the inflow of pressurized oil into the respective oil pressure chambers 65. An inflow path 68 for interconnecting the left and right outflow blocking check valves 66 themselves and an outflow path 69 for interconnecting the left and right inflow blocking check valves 67 themselves are provided along the body of the cylinder 62.

A change-over valve 70 for the large flow is provided in the interconnecting position of the inflow path 68 and the outflow path 69 and has an inlet port 72 and an outlet port 73 provided on one end side of a valve body and a back pressure port 74 provided on the other end side, for example. A shut-off valve 71 for blocking the outflow of pressurized oil toward the back pressure port 74 is provided in the flow path on the side of the back pressure port 74, a great capacity of pressurized oil is adapted to flow at high speed and to instantly shut off.

Further, according to the present invention, a bypass flow path is provided for passing the pressurized oil under the throttled condition even if the large flow change-over valve 70 is closed, and the damping coefficient is varied between the first damping coefficient $C_1$ under the opened condition and the second damping coefficient $C_2(>C_1)$ under the closed condition by opening and closing the large flow change-over valve 70.

Figure 3:
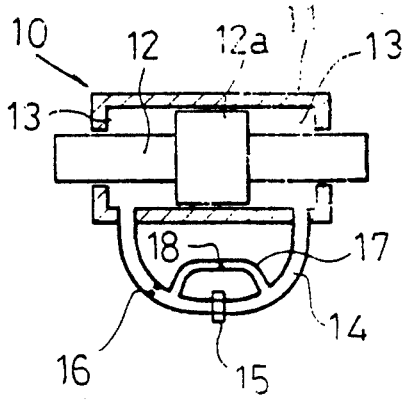
FIG. 3 is a conceptional view showing a cylinder lock device as an embodiment of a variable damping device used in the first active seismic response control system.

More particularly, as conceptionally shown in FIG. 3, the inflow path 68 or the outflow path 69 is provided with a first orifice 75. By designing the opening of the orifice 75, the predetermined first damping coefficient $C_1$ under the opening condition of the large flow change-over valve 70 is given, and by providing the orifice in the bypass flow path for the large flow change-over valve 70 or by designing the bypass path itself as an orifice 76, the predetermined second damping coefficient $C_2$ under the closed condition of the large flow change-over valve 70 is given, for example.

This variable damping device 61 is of a double-rod cylinder type, in which the length of a flow path is shortened by providing two paths, i.e., the inflow path 68 and the outflow path 69, the check valves 66, 67 and the large flow change-over valve to along the cylinder 62, and a large flow of pressurized oil is adapted to flow at high speed and to instantly shut off by expanding the flow path area to reduce the path resistance. Also, the flow path is instantly opened and closed by the use of the back pressure system large flow change-over valve 70, so that the response speed is extremely increased in cooperation with the constitution thereof as noted above.

Next will be described the operating condition of the variable damping device 61.

(1) Large flow change-over valve is open

When the shut-off valve 71 is opened, the piston 63 is moved to the left in FIG. 21, so that the pressurized oil of the left oil pressure chamber 65 flows through the inflow blocking check valve 67 and the outflow path 69 to push up the large flow change-over valve 70.

Since the left outflow blocking check valve 66 and the right inflow blocking check valve 67 are closed due to the pressurized oil, the pressurized oil flows from the large flow change-over valve 70 through the inflow path 68 and the right outflow blocking check valve 66. Thus, the pressurized oil flows from the left oil pressure chamber 65 to the right oil pressure chamber 65 to move the piston 63 to the left due to the external force.

Then, the orifice 75 in the outflow path 69 functions to give a resistance for against the flow of pressurized oil. Thus, the predetermined small damping coefficient $C_1$ approximate to that under the freed condition will be given to the device 61 by designing the opening of the orifice 75.

Even in the case where the piston 63 is moved to the right, the pressurized oil works symmetrically, so that the piston 63 is moved to the left due to the external force.

(2) Large flow change-over valve is closed

When the leftward external force is exerted to the piston 63 under the closed condition of the shut-off valve 71, oil pressure to the large flow change-over valve 70 is increased to push up the change-over valve 70. However, since the oil pressure in the back pressure port 74 is received by the shut-off valve 71, the large flow change-over valve 70 is also fixed under the closed condition to block the movement of the piston 63, provided that the pressurized oil flows through the orifice 76, as it receives the resistance, since the orifice 76 is formed in the bypass for the change-over valve 70 as mentioned above.

Thus, when the large flow change-over valve 70 is closed, the damping coefficient $C_2$ which is large than that under the opened condition and approximate to that under the fixed condition will be given.

The same may be said of the case where the rightward external force is exerted to the piston 63.

When the variable damping device 61 making use of the oil pressure is provided between the frame body and the variable stiffness element, the damping force for the frame body is given as a resistance ($P=cv^r$) approximately proportional to the power of the relative speed of the piston 63 to the cylinder 62 and, as mentioned above, the frame body shows the different characteristics depending on the magnitude (for example, amplitude) of vibration.

Further, in the above embodiment, each of the check valves 66, 67 is so constituted that a right-like valve body is urged by the action of a spring to flow the pressurized oil only in one direction, for example. Also, the shut-off valve 71 is changed over in two positions, i.e., opening and closing positions by the use of a solenoid 77. Further, as shown in the drawing, an accumulator 78 communicating to the inflow path 68 is mounted on the cylinder 62. The accumulator serves as an oil reservoir for pressurizing the pressurized oil in the cylinder 62 with a pressure resulting from adding $\alpha$ to the atmospheric pressure (i.e., the atmospheric pressure$+\alpha$) to supply the oil in leakage, prevent the oil from mixing with bubbles, and compensate for a volume change due to the change of temperature and the compression of the oil in the locking.

Figure 22:
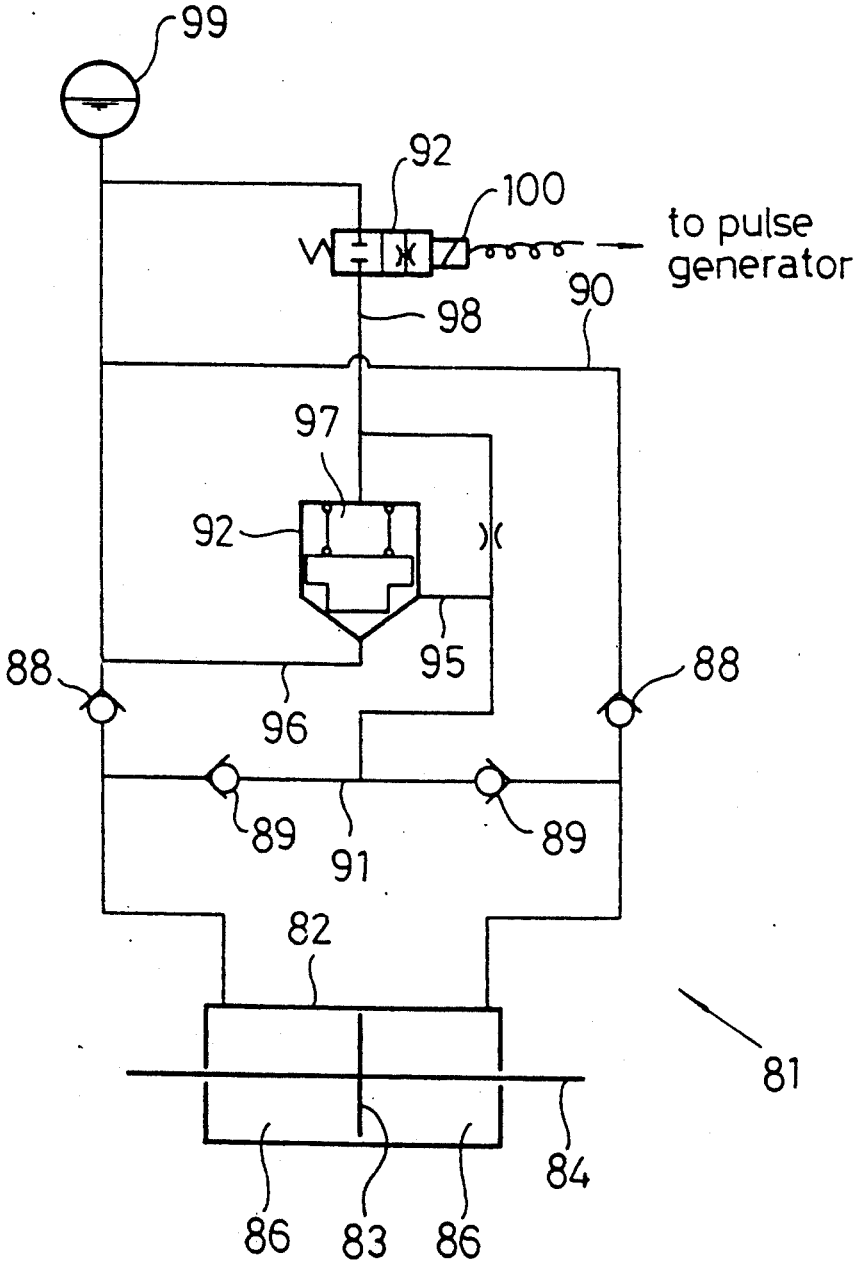
FIG. 22 is an oil pressure circuit diagram showing an embodiment of the cylinder lock device to be used in the second and third active seismic response control systems.

FIG. 22 shows an embodiment of an oil pressure circuit of a variable damping device 81 used in each of the active seismic response control systems 2 and 3. As shown in the drawing, the device body includes left and right oil pressure chambers 86 located on the left and right of a piston 83 of a double-rod type reciprocating in a cylinder 82. Pressurized oil in the left and right oil pressure chambers 86 is confined or caused to flow by a valve, sot hat the piston 83 is fixed or moved to the left and right.

One of the cylinder 82 and the rod 84 is connected to one of the frame body of the structure and the variable stiffness element or one of the variable stiffness elements themselves, and the other is connected to the other of the frame body and the variable stiffness element or the other of the variable stiffness elements themselves.

The left and right oil pressure chambers 86 are provided respectively with left and right outflow blocking check valves 88 for blocking the outflow of pressurized oil from the respective oil pressure chambers 86 and left and right inflow blocking check valves 89 for blocking the inflow of pressurized oil into the respective oil pressure chambers 86. An inflow path 90 for interconnecting the left and right outflow blocking check valves 88 themselves and an outflow path 91 for interconnecting the left and right inflow blocking check valves 89 themselves are provided along the cylinder body 82.

A flow regulating valve 92 is provided in the connecting position of the inflow path 90 and the outflow path 91 to be opened and closed in response to the pulse signal from a pulse generator connected to a computer, so that the damping coefficient C of the variable damping device 81 can be adjusted by varying the opening of the flow regulating valve 92.

This variable damping device 81 can be conceptionally considered to be a simplified form as shown in FIG. 15. For example, the variable damping device serves as a variable stiffness device for varying the stiffness of the frame body if only the locked condition, of which the flow regulating valve 92 is completely closed, and the freed condition, of which the flow regulating valve 92 is completely closed, and the freed condition, of which the flow regulating valve 92 is completely opened, are controlled. On the other hand, by adjusting the opening of the flow regulating valve 92 to delicated adjust the connection condition between the completely locked condition and the completely freed condition, various damping coefficients C are given to provide the natural period and the damping factor h of the frame body at the time of adjustment according to the damping coefficient C and the vibrational condition of the frame body.

Figure 16:
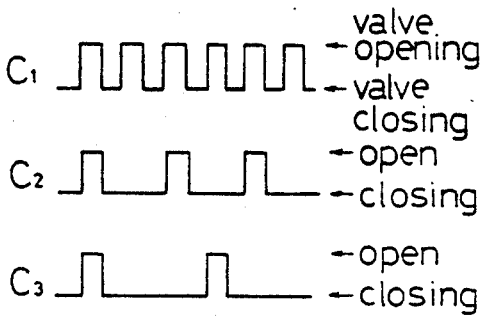
FIG. 16 is a view for explaining the relationship between the damping coefficient of the variable damping device and pulse signals in the case where the opening of an orifice using a high speed switch valve is adjusted in response to the pulse signal to be controlled by a valve opening time.

The opening of the flow regulating valve 92 is considered in relation to the time by adjusting the interval of pulse signals sent from the pulse generator. That is, as shown in FIG. 16, the various openings and various damping coefficients C accompanying the change in opening are realized by varying the time, during which the flow regulating valve 92 is opened.

More particularly, as shown in the drawing, the flow regulating valve 92 has an inlet port 95 and an outlet port 96 provided on one end side of a valve body, and is composed of a change-over valve **92*a* having a back pressure port 97 provided on the other end side of the valve body and a shut-off valve 92*b* provided in a bypass flow path 98 interconnecting the inlet port 95 of the change-over valve 92*a* and the back pressure port 97 and capable of blocking the outflow of pressurized oil to the back pressure port 97. The shut-off valve 92*b* is opened and closed in response to the pulse signals sent from the pulse generator on the reception of the command from the computer, and the change-over valve 92*a*** is operated with the opening and closing of the shut-off valve.

Also, an accumulator 99 is preferably provided in the inflow path 90 or the outflow path 91 in order to compensate for the volume change due to the compression of working fluid and the change of temperature.

This variable damping device is of a double-rod cylinder type, in which the length of a flow path is shortened by providing two paths, i.e., the inflow and outflow paths, the check valve and the flow regulating valve along the cylinder, and a large flow of pressurized oil is adapted to flow at high speed and to instantly shut off by expanding the flow path area to reduce the path resistance. Also, the flow path is instantly opened and closed by the use of the back pressure type flow regulating valve, so that the response speed is extremely increased in cooperation with the constitution thereof as noted above.

Next will be described the operating condition of the variable damping device 81 according to this embodiment.

(1) Flow regulating valve is opened

When the shut-off valve **92*b* is opened, the piston 82 is moved to the left in the drawing, so that pressurized oil int eh left oil pressure chamber 86 flows through the inflow blocking check valve 89 and the outflow path 91 to push up the change-over valve 92*a***.

Since the left outflow blocking check valve 88 and the right inflow blocking check valve 89 are closed due to the pressurized oil, the pressurized oil flows from the change-over valve **92*a* through the inflow path 90 and the right outflow blocking check valve 88. Thus, the pressurized oil flows form the left oil pressure chamber 86 to the right oil pressure chamber 86 to move the piston 82** to the left due to the external force.

Even in the case where the piston 82 is moved to the right, the pressurized oil works symmetrically, so that the piston is moved to the left due to the external force.

(2) Flow regulating valve is closed

When the shut-off valve 92b is closed and the leftward external force is exerted to the piston 82, the oil pressure o the change-over valve 92a is increased to push up the piston 82. However, since the bypass flow path 18 is shut off by the shut-off valve 92b to receive the oil pressure in the back pressure port 97, the change-over valve 92a is also fixed under the closed condition to block the movement of the piston 82. The same may be said of case where the rightward external force is exerted to the piston 82.

When the variable damping deice 81 making use of the oil pressure as noted above is provided between the frame body and the variable stiffness element, the damping force for the frame body is given as a resistance force ($P=cv^r$) proportional to the power of the relative speed of the piston 82 to the cylinder 62, and the frame body shows the different characteristics depending on the magnitude (for example, amplitude) of vibration.

FIGS. 23 through 30 show the positions, in which two kinds of variable damping devices as noted above are applied to the frame of the structure.

Figure 23:
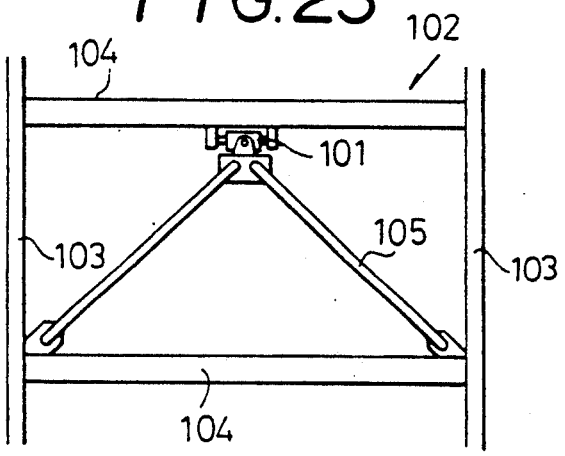
FIGS. 23 through 30 are schematic views showing the positions, in which the variable damping device is applied to the frame of the variable damping and stiffness structure according to the present invention, respectively.

In an embodiment shown in FIG. 23, a variable damping device 101 is interposed between a post-beam frame serving as a frame body 102 and an inverted V-shaped brace 105 serving as the variable stiffness element.

Figure 24:
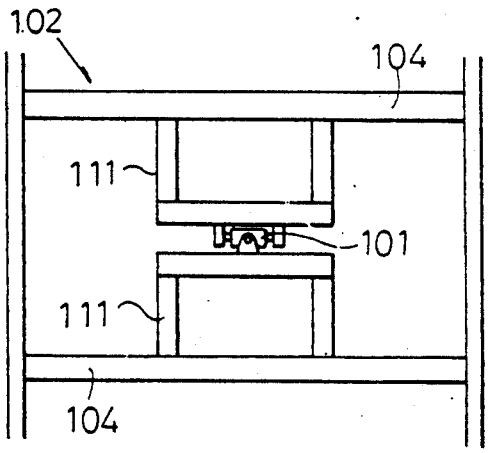

In an embodiment shown in FIG. 24, the variable damping device 101 is interposed between a post-beam frame serving as the frame body 102 and frames 111 themselves erected on or suspended from upper and lower beams 104 to constitute a moment resisting frame as the variable stiffness element.

Figure 25:
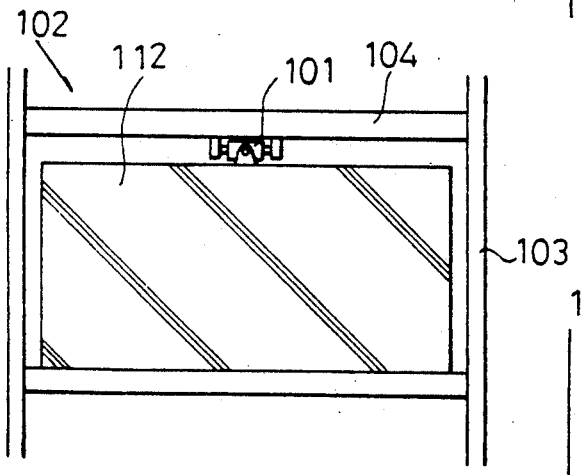

In an embodiment shown in FIG. 25, the variable damping device 101 is interposed between a post-beam frame serving as the frame body 102 and a RC quake resisting wall 112 serving as the variable stiffness element.

Figure 26:
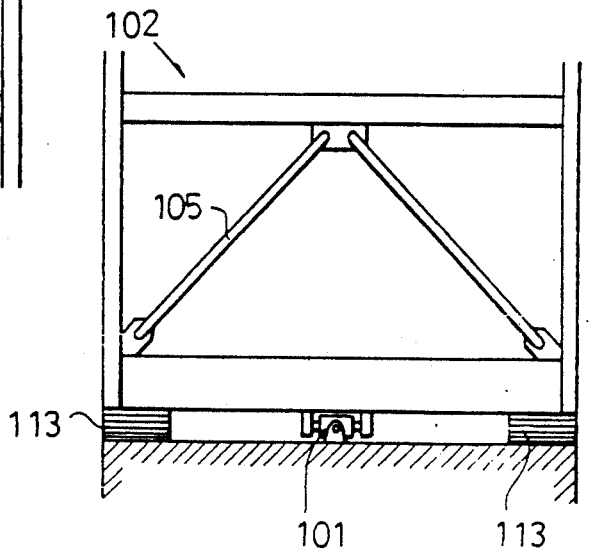

In an embodiment shown in FIG. 26, the variable damping device 101 is provided on the foundation of a base isolation structure in combination with base isolation rubber such as laminated rubber. In the case, the variable damping device 101 serves as a damper in the base isolation structure, and the variable stiffness element may be considered to be the foundation of the structure.

Figure 27:
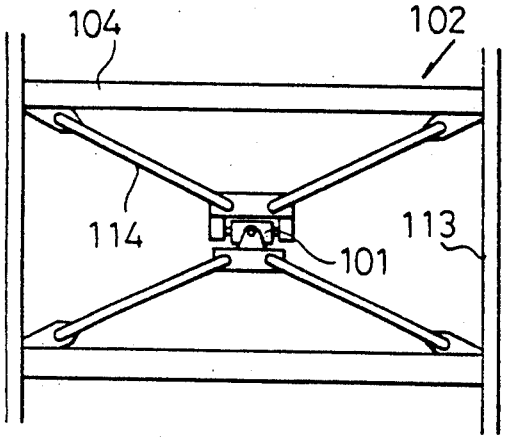

In an embodiment shown in FIG. 27, a X-shaped brace 114 provided in the post-beam frame serving as the frame body 102 is provided in the post-beam frame serving as the variable stiffness element, and the variable damping device 101 is interposed laterally (lateral type) in the center of the X-shaped brace.

Figure 28:
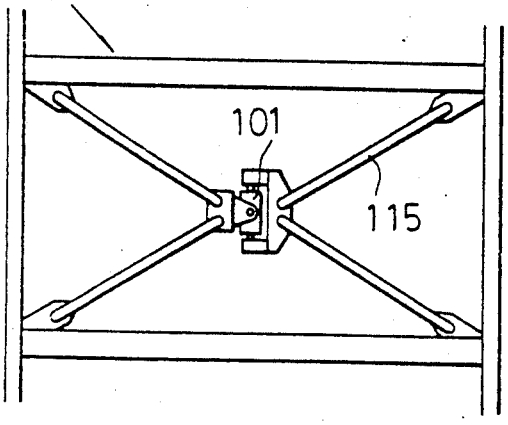

FIG. 28 shows an embodiment similar to that shown in FIG. 27, in which the variable damping device is applied to the X-shaped brace 115. While the embodiment shown in FIG. 27 is of a lateral type, in which the variable damping device 101 is provided laterally, this embodiment shown in FIG. 28 is of a vertical type, in which the variable damping device is provided vertically.

Figure 29:
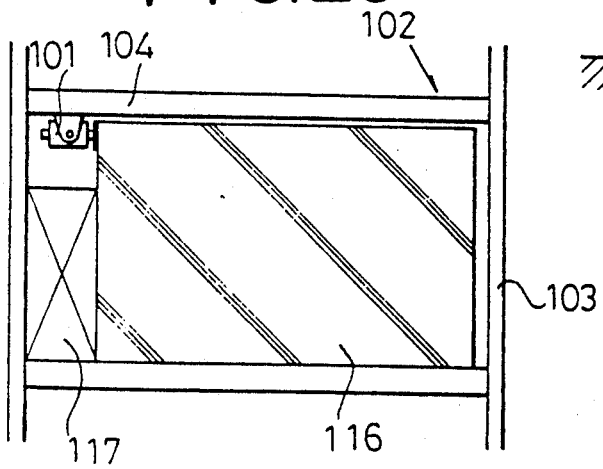

An embodiment shown in FIG. 29 is similar to that shown in FIG. 25, in which the variable damping device 101 is interposed between a post-beam frame serving as the frame body 102 and a RC quake resisting wall 116 serving as the variable stiffness element. The embodiment shown in FIG. 29 has a feature in that the variable damping device 101 is provided above and opening 117 of a doorway or the like.

Figure 30:
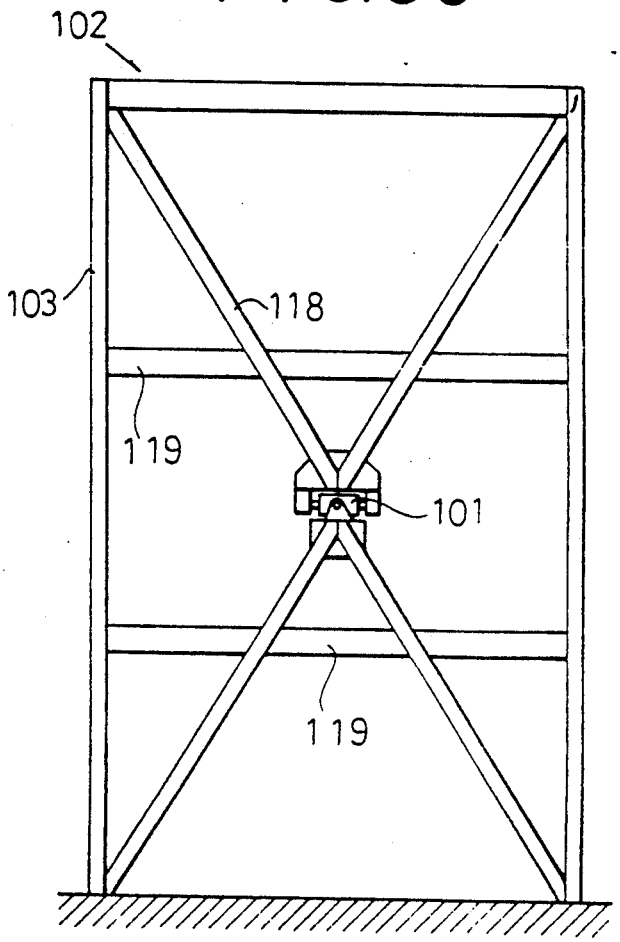

In an embodiment shown in FIG. 30, the variable damping device 101 is interposed in the center of a X-shaped brace 118 in a large frame, and an intermediate large beam 119 is separated from the brace 118.

FIGS. 31 through 42 show embodiments of the present invention applied to structure like high-rise buildings having large bending deformation, and any of the control systems 1 through 3 is applied to these embodiments as the control system.

The vibration of the high-rise building due to an earthquake and wind includes the shearing deformation of the frame due to the bending deformation and the shearing deformation of the post and beam and the bending deformation of the whole frame due to the axial deformation of the post. Usually, the vibration of the building takes place as the total of aforementioned two deformations, and the higher the height of a slender building is relative to the width thereof, the larger the bending deformation of the whole frame is.

On the other hand, the conventional variable stiffness structure often cope with the above deformation by controlling the stiffness of the frame on every story, so that the complicated control is necessary to cope with the bending deformation, and the rational control is not always obtained.

In this embodiment, a rod-like control member extending over at least a plurality of stories in the height direction of the building is provided along the post of the building of a plurality of stories. The upper and lower portions of the control member are respectively connected to portions of the building, preferably the uppermost and lowermost portions. The variable damping device capable of varying the connecting condition is provided on the way or the end of the control member and adapted to control the stiffness or the damping force of the building in the form of control of the bending deformation against the vibrational disturbance like an earthquake and wind.

Figure 31:
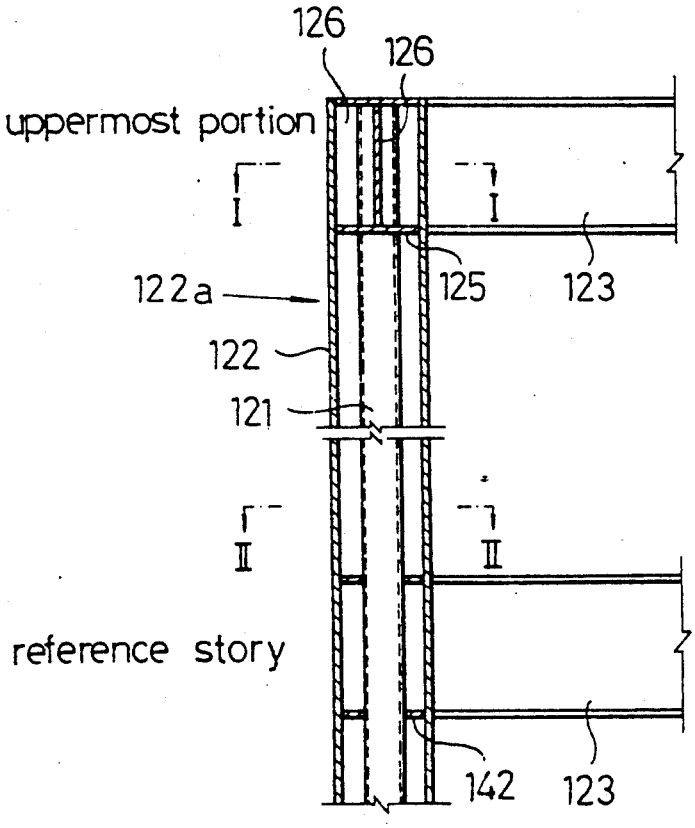
FIG. 31 is a vertical sectional view showing an embodiment of the variable damping and stiffness structure sub to bending deformation control.
Figure 32:
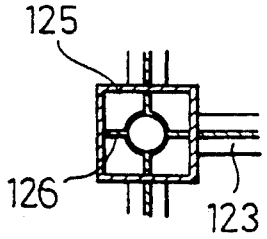
FIG. 32 is a sectional view taken along the line I—I in FIG. 31.
Figure 33:
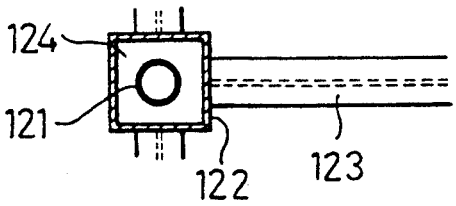
FIG. 33 is a sectional view taken along the line II—II in FIG. 31.
Figure 33:
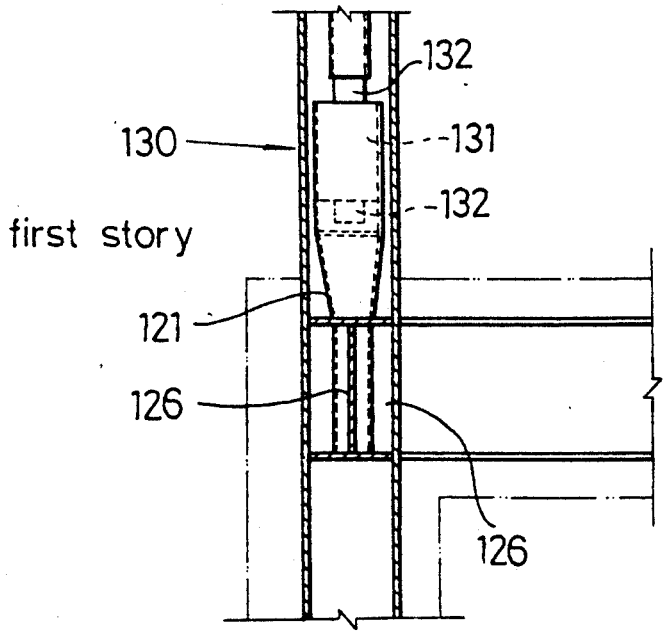

Referring to FIGS. 31 through 33, an inside steel pipe 121 serving as the control member is provided inside an outside steel pipe 122 constituting an outer post 122a of a high-rise building. The inside steel pipe 121 has the uppermost and lowermost portions respectively rigidly connected to a connecting plate 126 and a diaphragm 15. The axial force of the outside steel pipe 122 in the uppermost portion is transmitted to the inside steel pipe 121 and the axial force of the inside steel pipe 121 in the lowermost portion is transmitted to the underground post and the foundation.

Also, as shown in FIG. 33, the inside steel pipe 121 on the reference story is separated from the diaphragm 124 in the post-beam connection through a fine gap to permit the axially relative movement of the inside steel pipe 121 according to the condition of a cylinder lock device 130 provided in the lower portion of the inside steel pipe 121.

Figure 34:
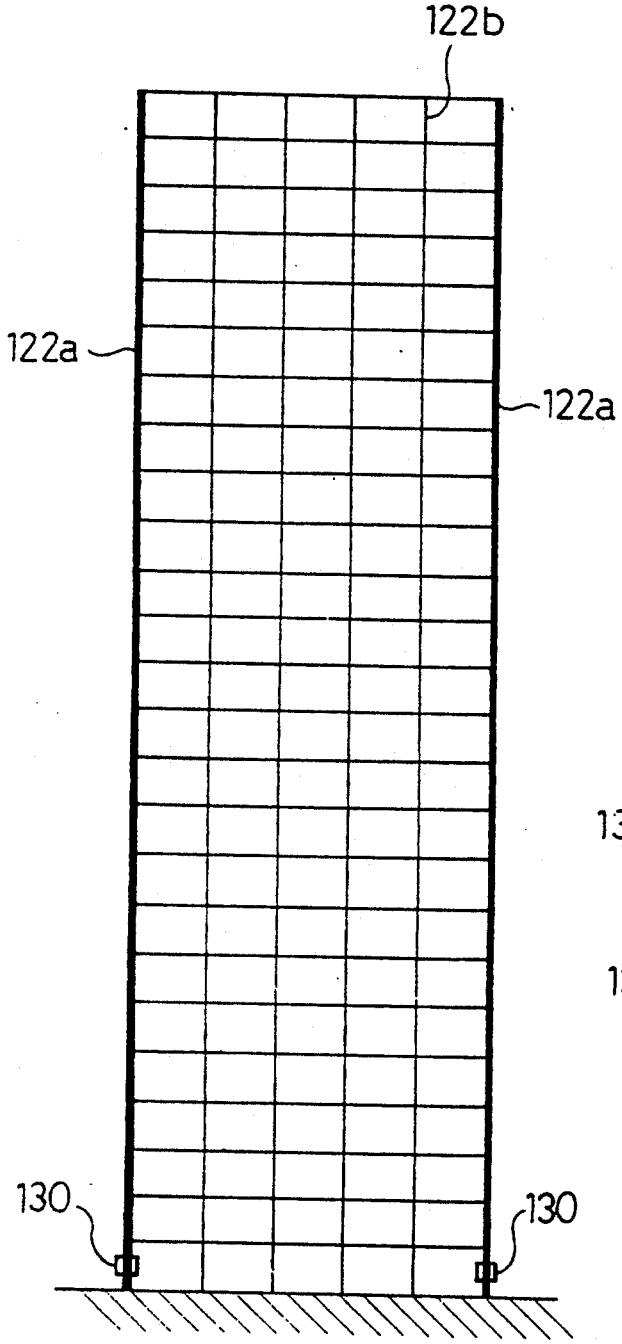
FIG. 34 is an elevation showing the outline of a building in the case of the variable damping and stiffness structure.
Figure 35:
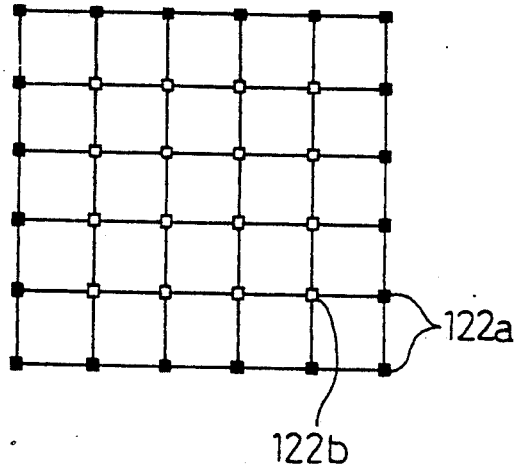
FIG. 35 is a plan view showing the building of FIG. 34.

FIGS. 34 and 35 show the outline of a building, respectively. In this embodiment, the above double-steel pipe structure is applied to only the outer post 122a on the outer periphery of the building having a large effect, and the normal structure is applied to the inside post 122b. Also, the cylinder lock device 130 is provided on the first story portion of the outside post 122a.

Figure 36:
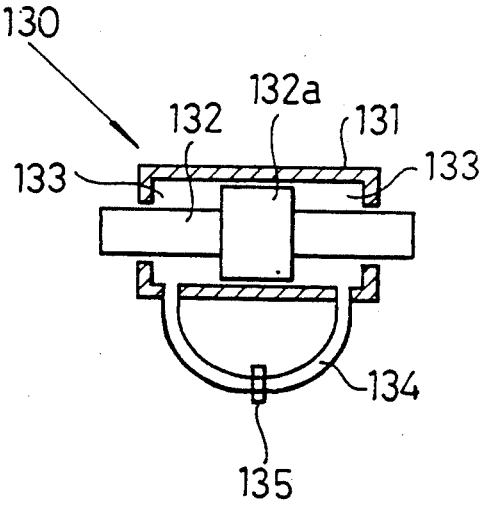
FIG. 36 is a conceptional view showing the cylinder lock device serving as the variable damping device.

FIG. 36 is a conceptional view showing the cylinder lock device 130 corresponding to that shown in FIG.

15. A double-rod type piston 132a is inserted into a cylinder 131 and a switch valve 135 is provided in an oil path 134 for interconnecting left and right oil pressure chambers 133 located on the left and right of the piston 132a. The damping and resistance forces can be varied actively by controlling the opening of the switch valve 135 on multiple stages. Also, when the opening of the switch valve 135 is selected between the fully opened condition and the fully closed condition of the opening, two conditions, i.e., the freed and locked conditions can be realized. Further, a damping force in this case is given as a resistance force proportional to the relative speed of the piston 132a to the cylinder 131 or the power of this relative speed.

This cylinder lock device 130 is provided on the way of the inside steel pipe 121 to be connected thereto such that the motion of the post 122a due to its expansion and contraction results int he relative displacement of the piston 132a to the cylinder 131 of the cylinder lock device 130.

When the cylinder lock device 130 is controlled under two conditions, i.e., freed and locked conditions as above mentioned, the cylinder lock device can be controlled inc consideration of the unresonance property by allowing the post to be expanded and contracted or restraining the post from its expansion and contraction similarly to the case of the conventional active seismic response control system and variable stiffness structure. Also, the cylinder lock device can be controlled inc consideration of the damping property or both the unresonance property and the damping property according to the frame characteristics of the building by controlling the switch valve 135 on multiple stages or providing an orifice having the proper opening to adjust the damping coefficient of the cylinder lock device 130.

The following table (Table-4) and FIGS. 37 through 42 summarize the relationship between the deformed condition of the building and the condition of the cylinder lock device 130 or the like, respectively.

TABLE-4

Figure 37:
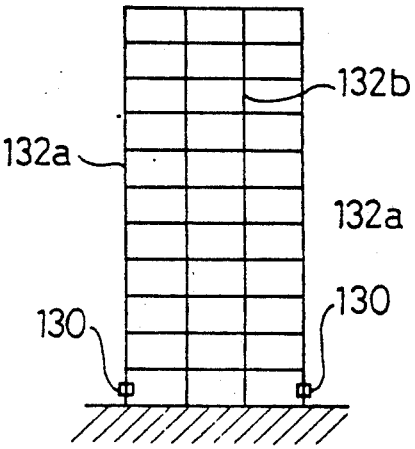
FIG. 37 is a schematic view showing a building under the normal condition.
Figure 41:
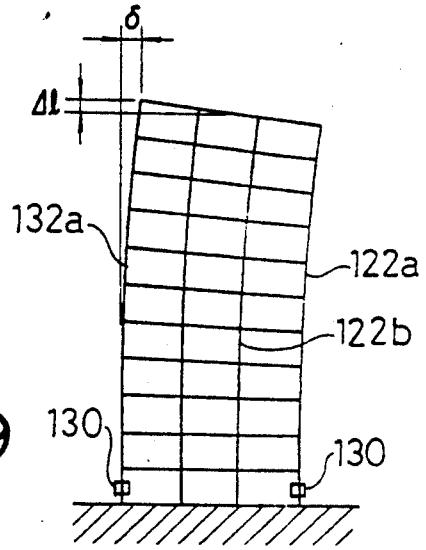
FIG. 41 is a schematic view showing a building under the condition that the building has high damping to earthquake and wind or is locked.
Figure 39:
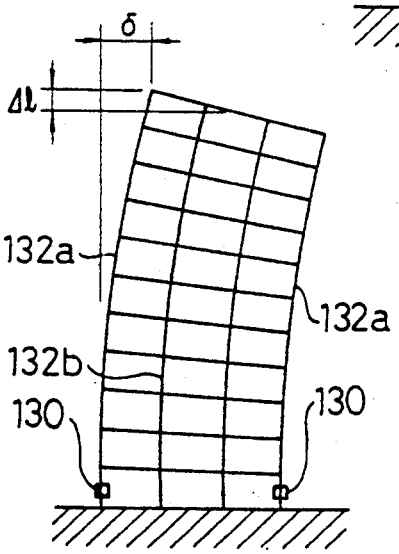
FIG. 39 is a schematic view showing a building under the condition that the building has low damping to earthquake and wind or is free from damping.
Figure 38:
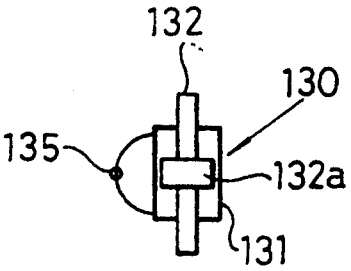
FIG. 38 is a constitutional view showing the cylinder lock device under the normal condition.
Figure 40:
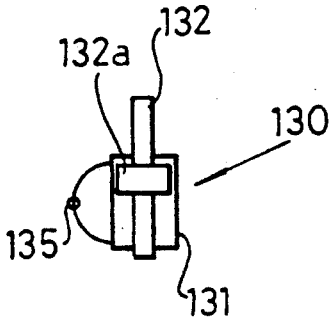
FIG. 40 is a constitutional view showing the cylinder lock device under the condition as shown in FIG. 39.
Figure 42:
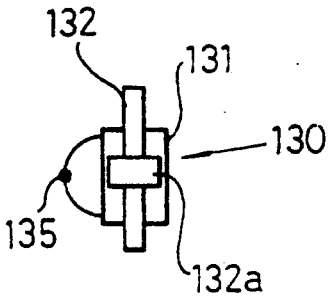
FIG. 42 is a constitutional view showing the cylinder lock device under the condition as shown in FIG. 41.
Figure 1:
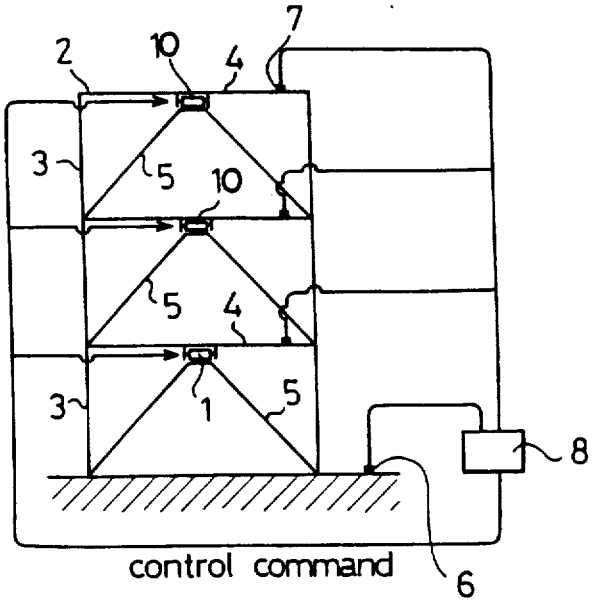
Figure 3:
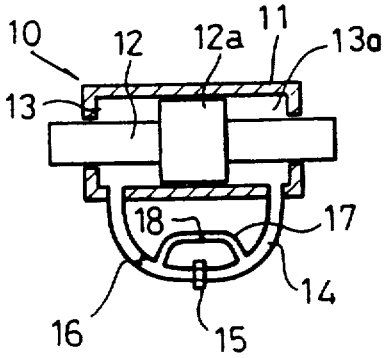
Figure 4:
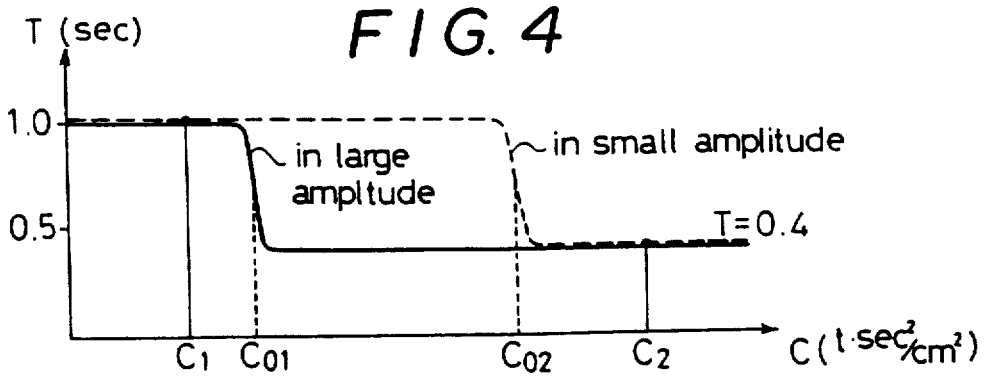
Figure 5:
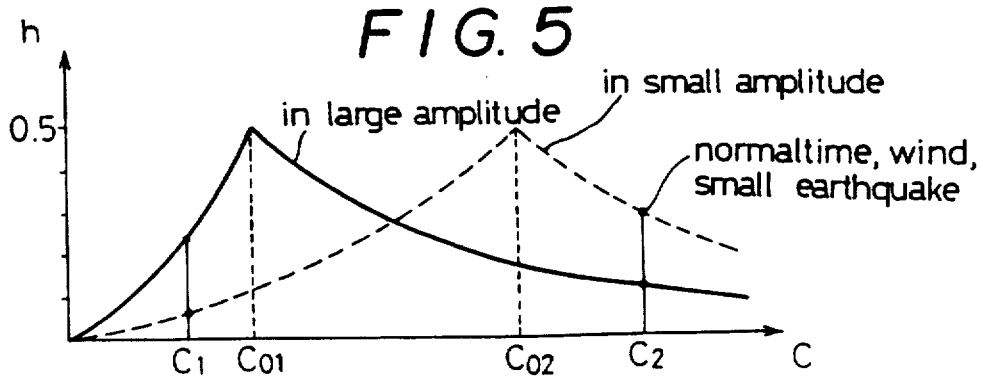
Figure 2:
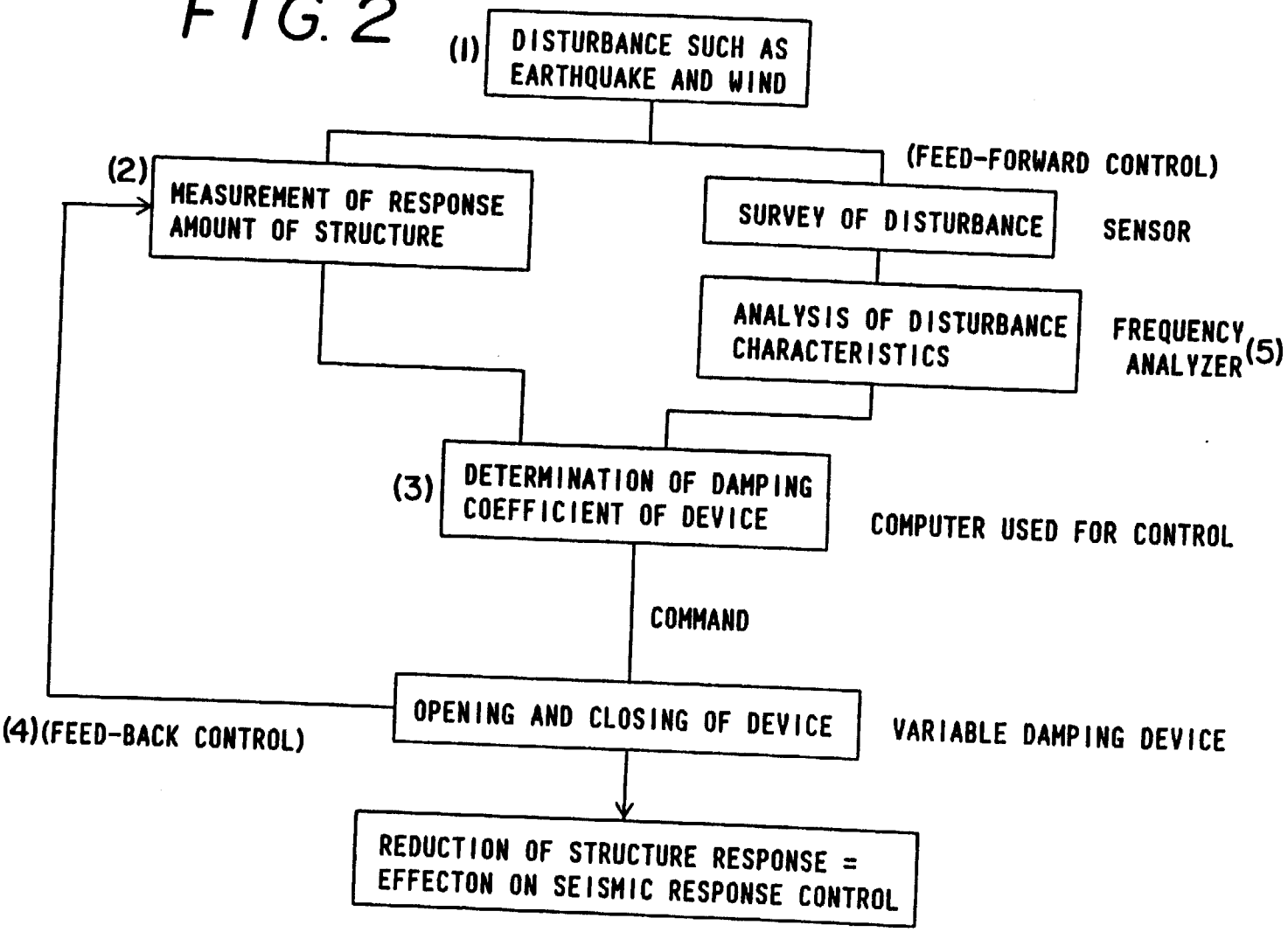
Figure 6:
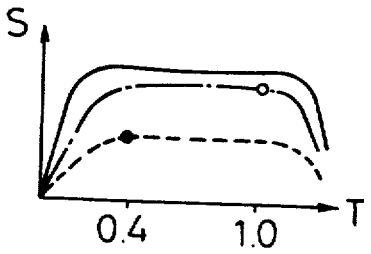
Figure 7:
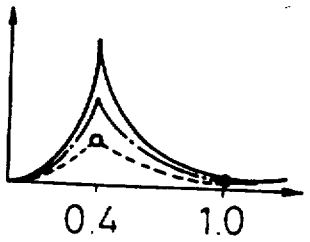
Figure 8:
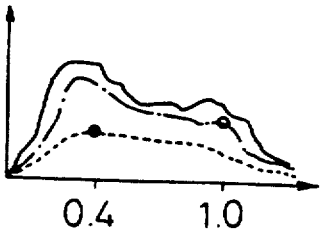
Figure 9:
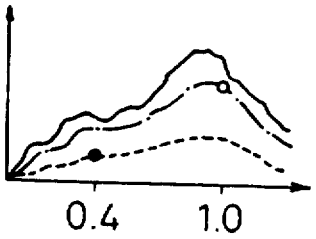
Figure 10:
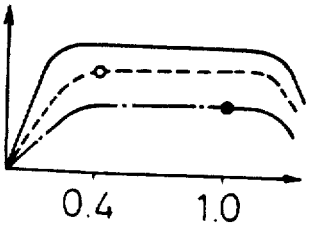
Figure 11:
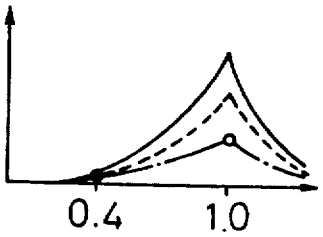
Figure 12:
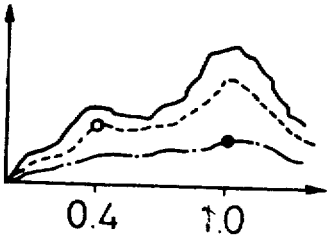
Figure 13:
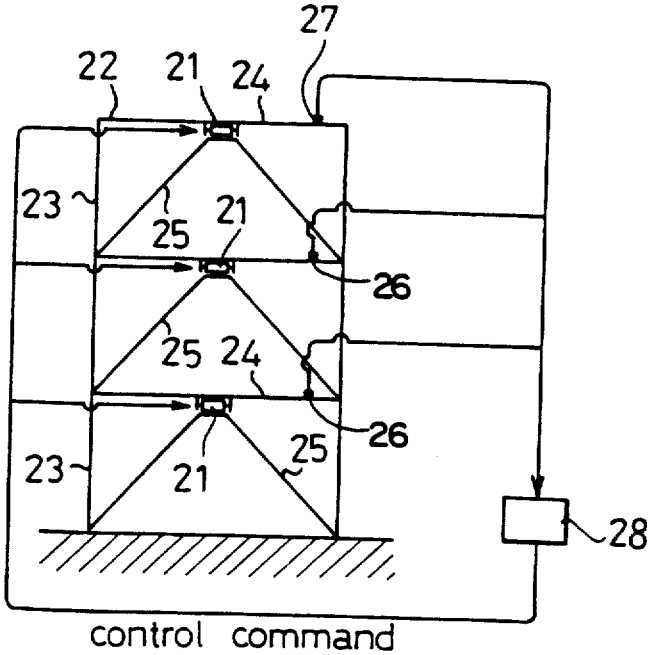
Figure 14:
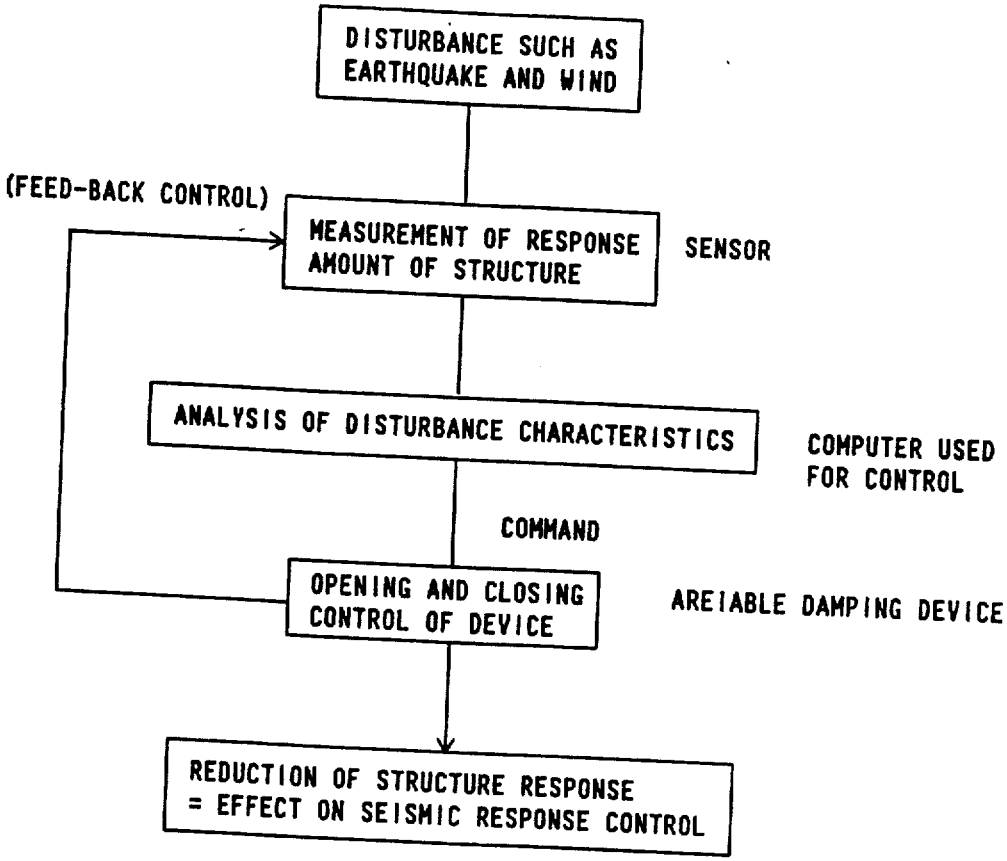
Figure 15:
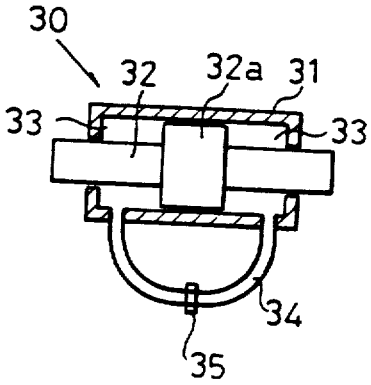
Figure 16:
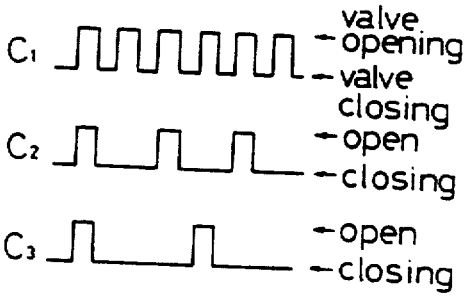
Figure 17:
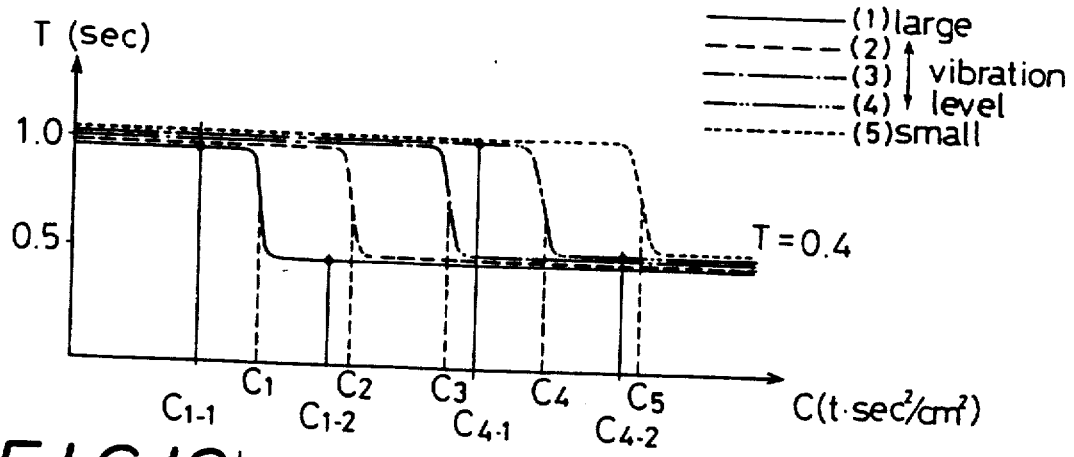
Figure 18:
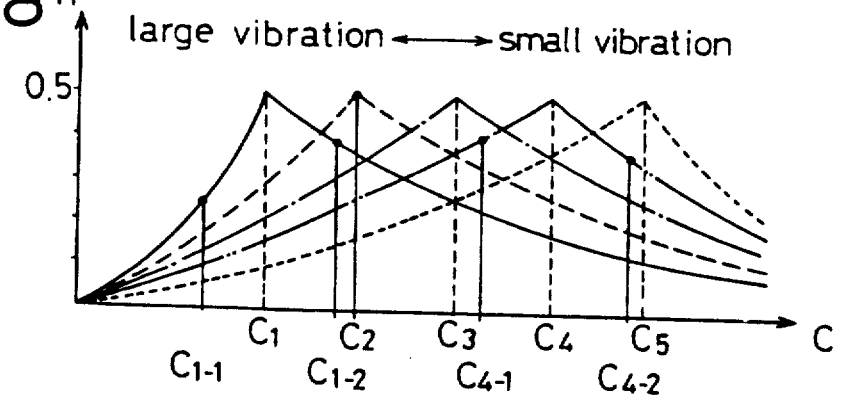
Figure 19:
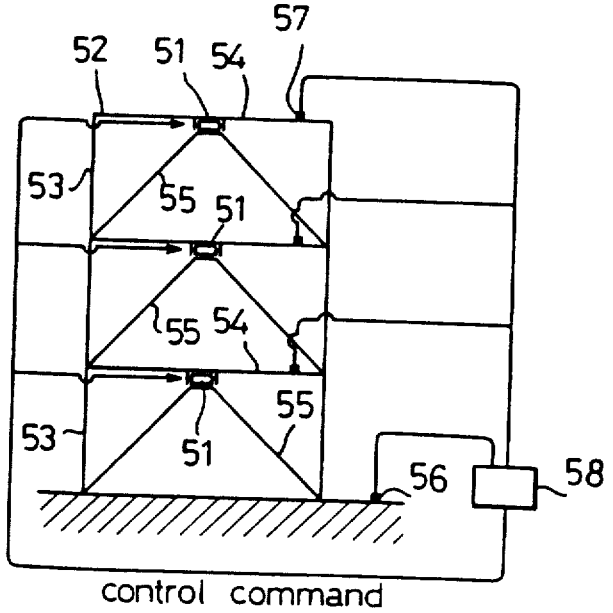
Figure 20:
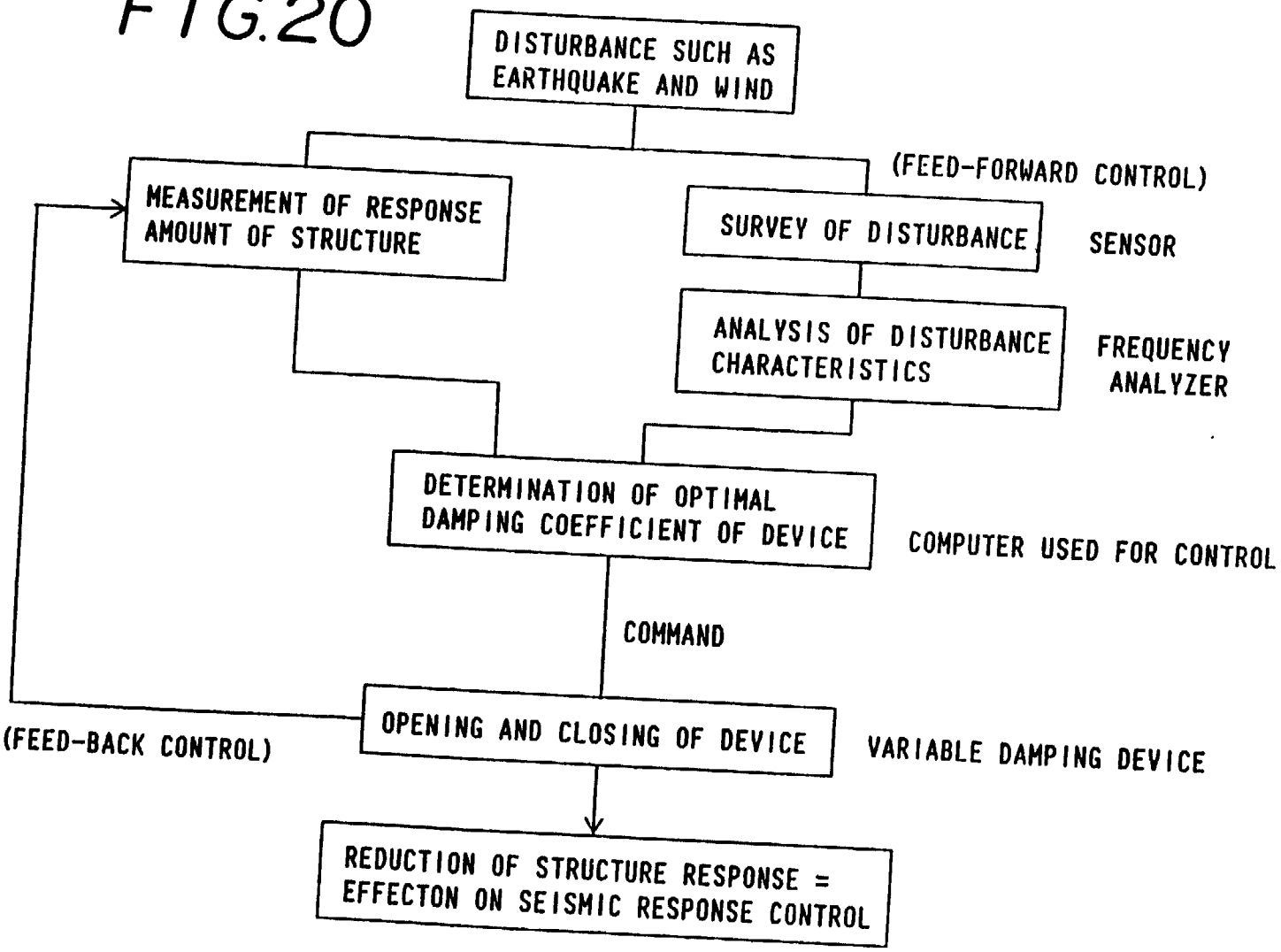
Figure 21:
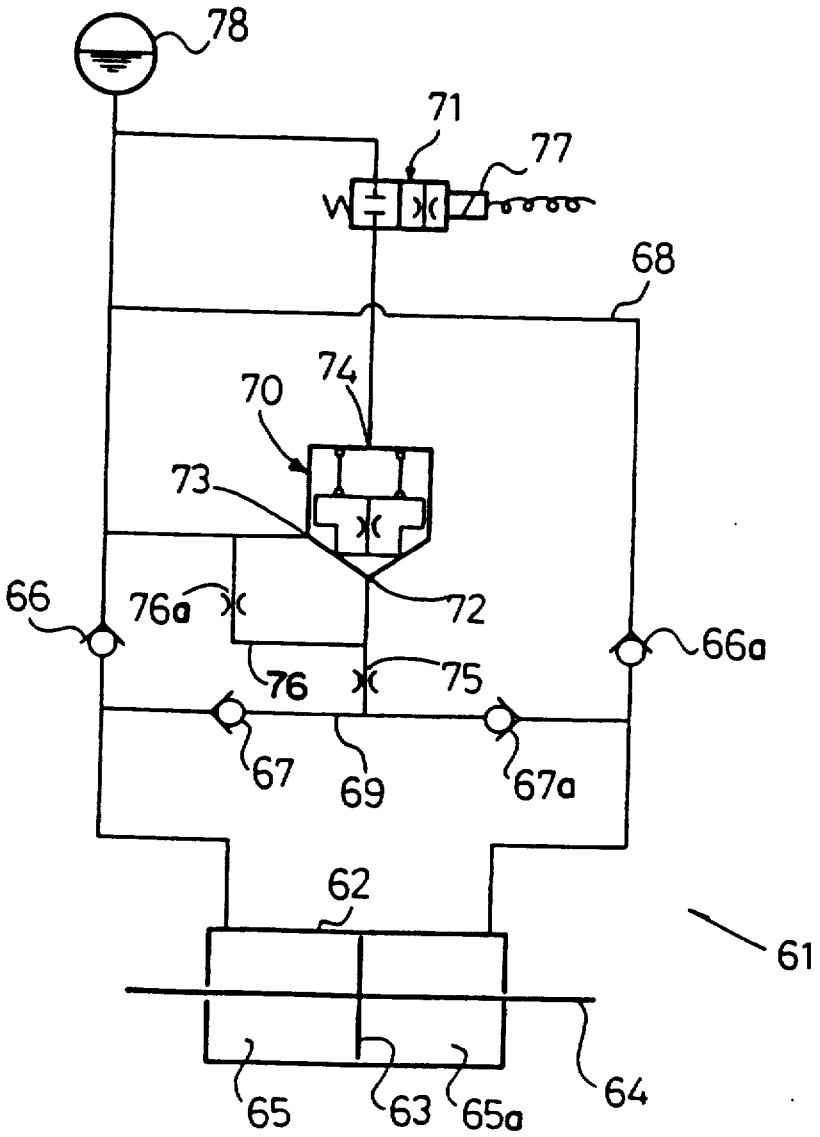
Figure 22:
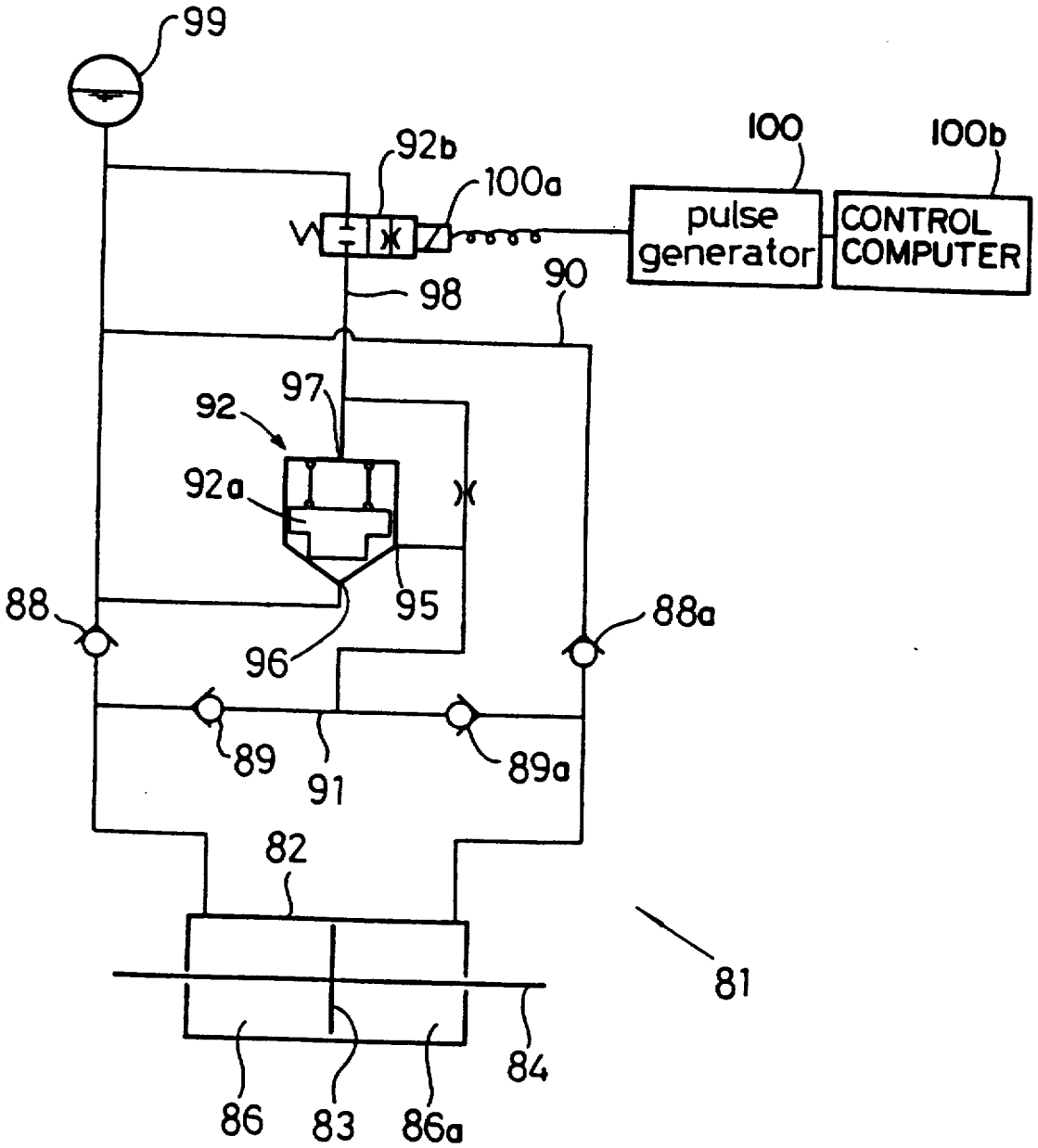
Figure 23:
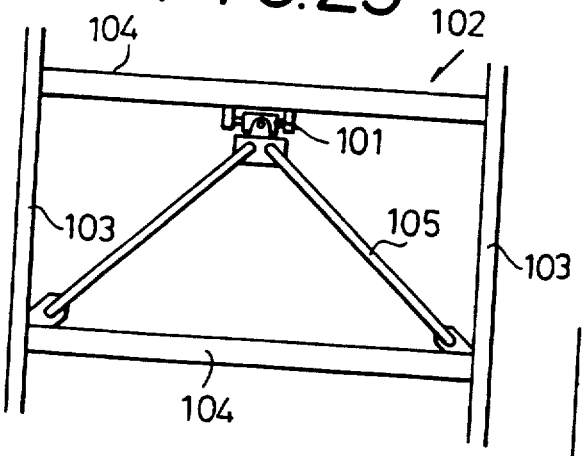
Figure 24:
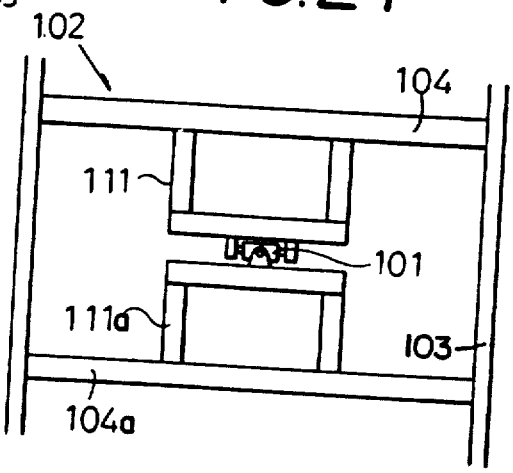
Figure 25:
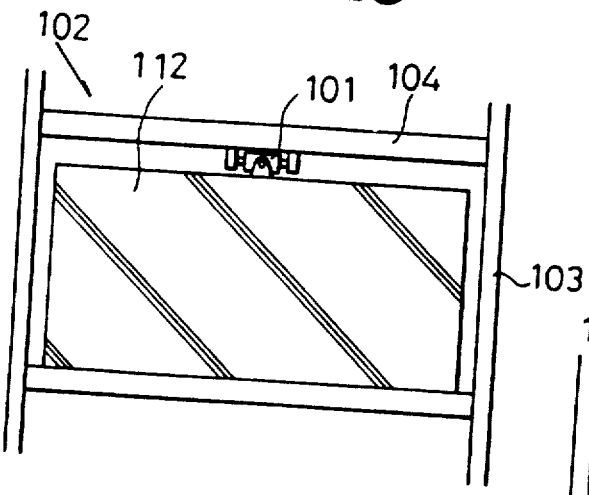
Figure 26:
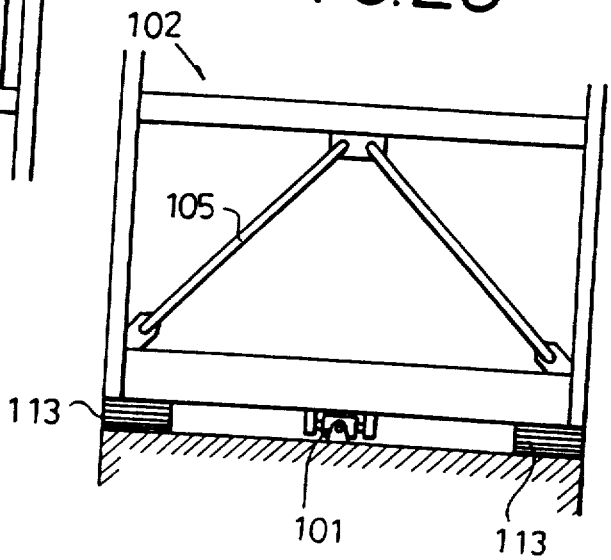
Figure 27:
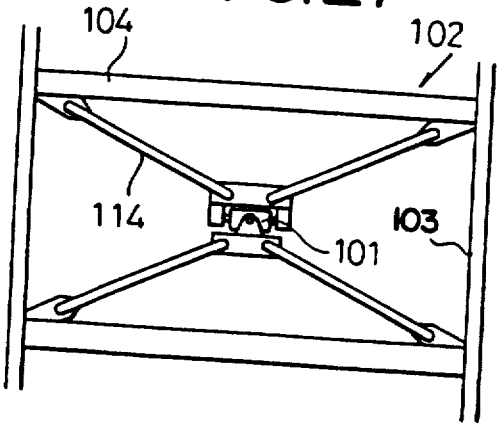
Figure 28:
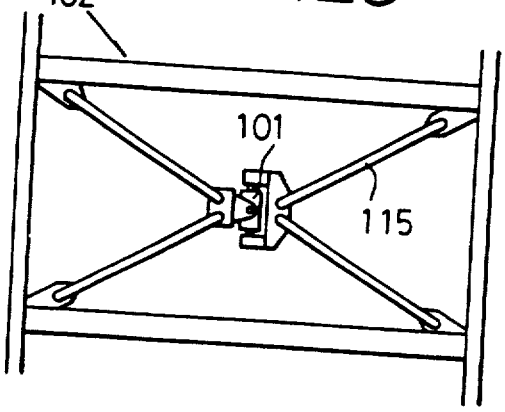
Figure 29:
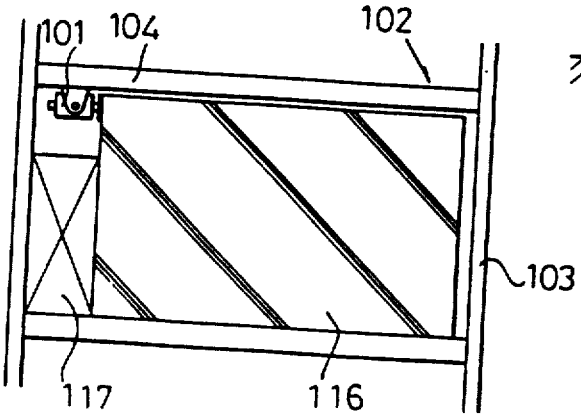
Figure 30:
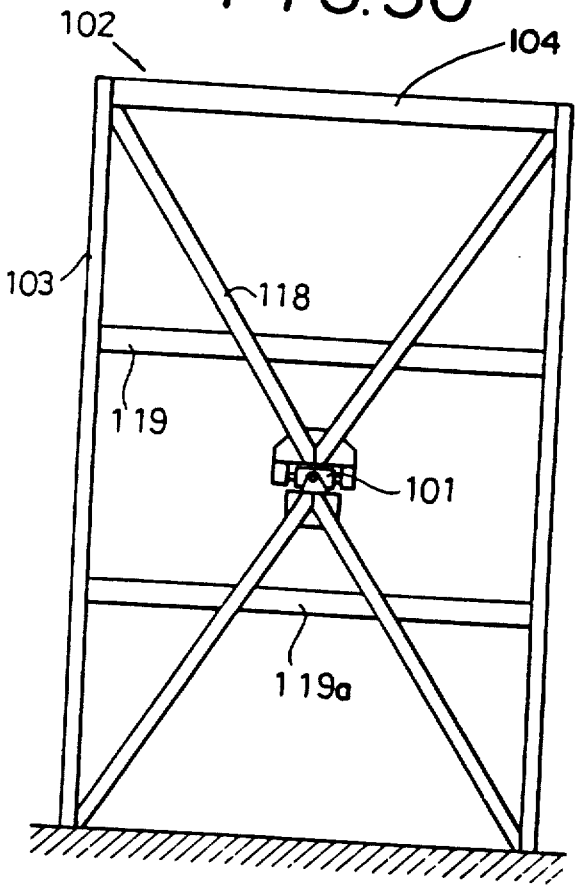
Figure 31:
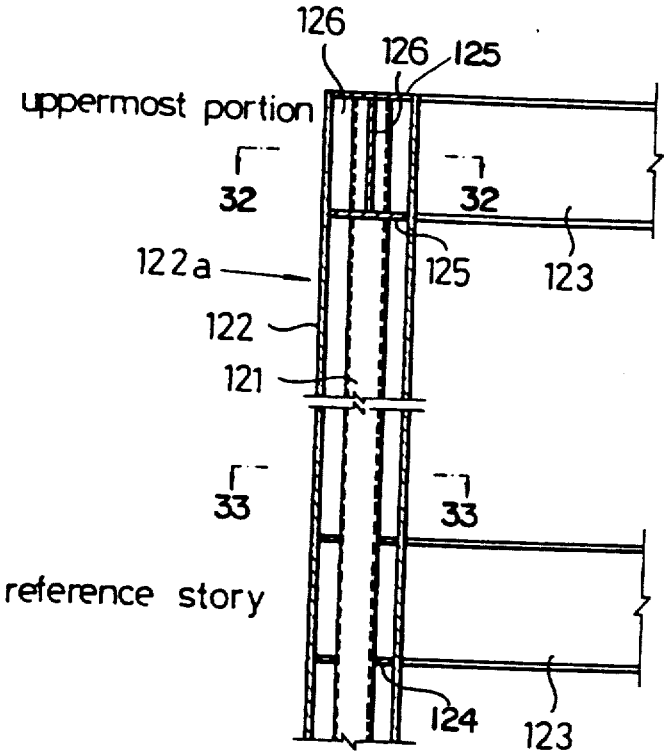
Figure 32:
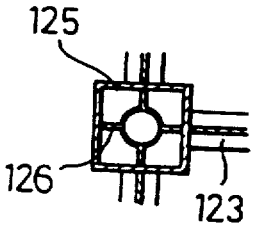
Figure 33:
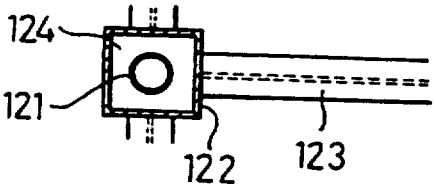
Figure 33:
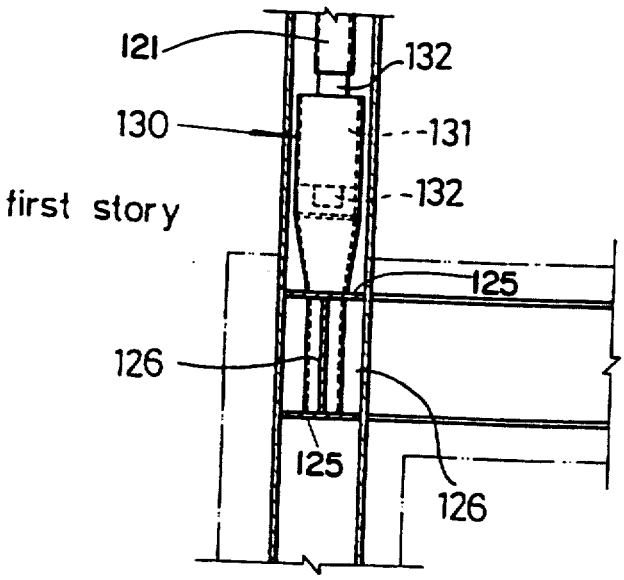
Figure 34:
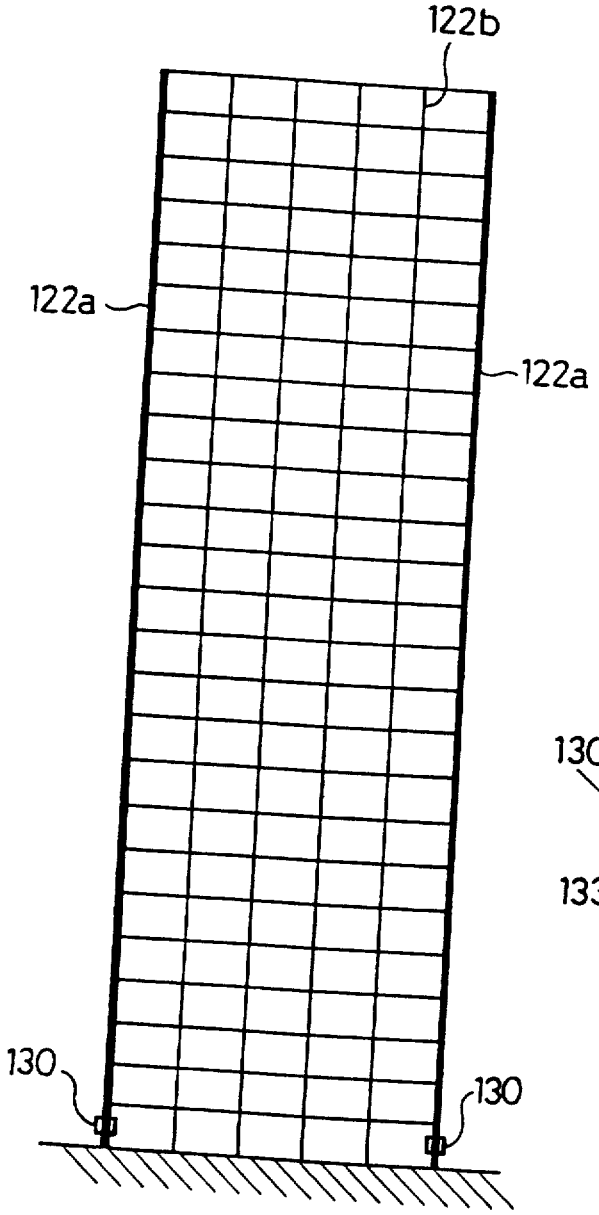
Figure 35:
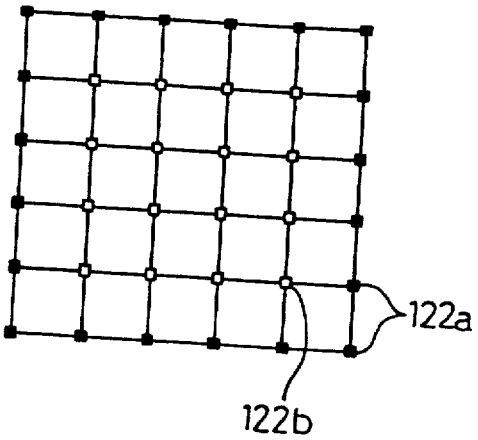
Figure 36:
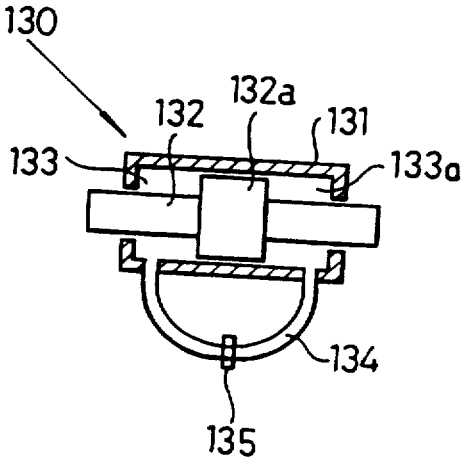
Figure 37:
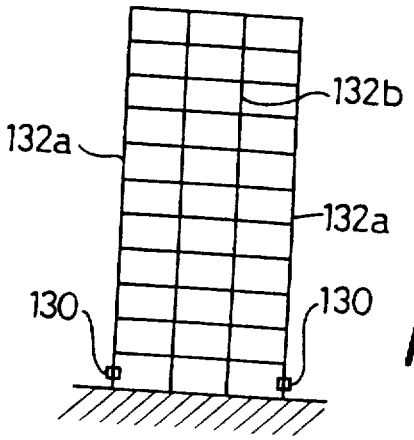
Figure 41:
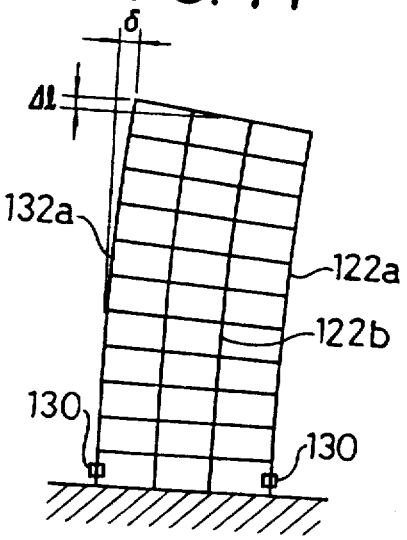
Figure 39:
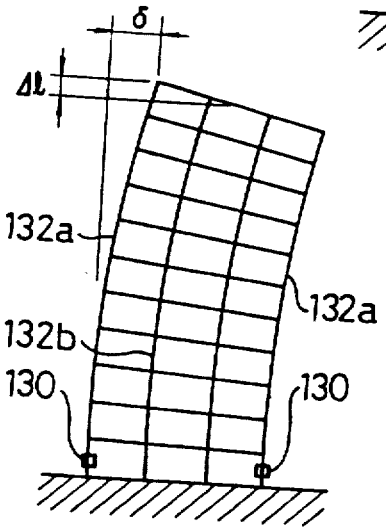
Figure 38:
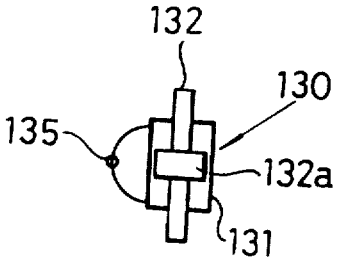
Figure 40:
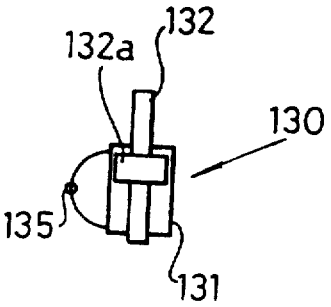
Figure 42:
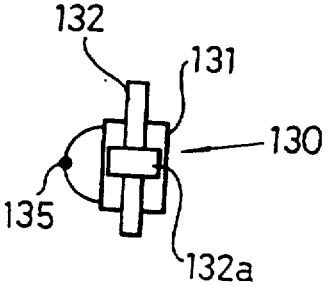
Figure 37:
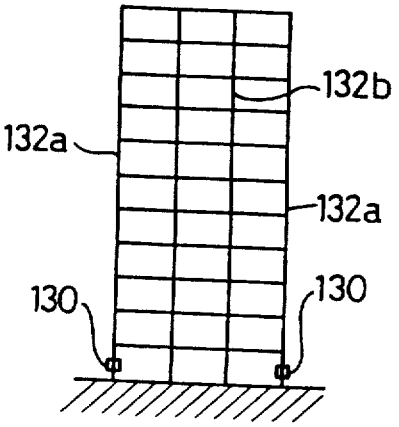
Figure 41:
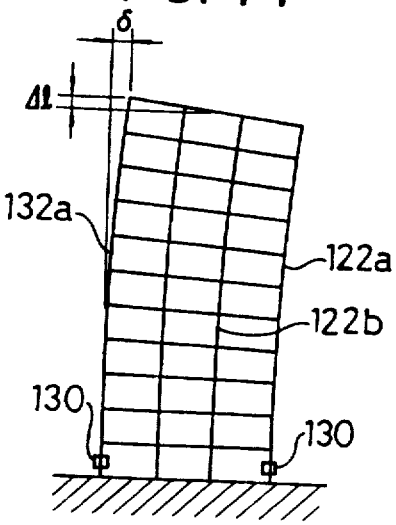
Figure 39:
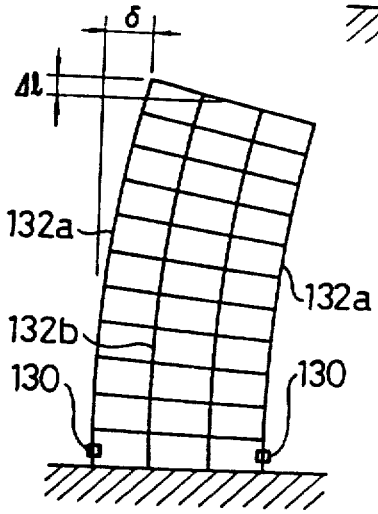
Figure 38:
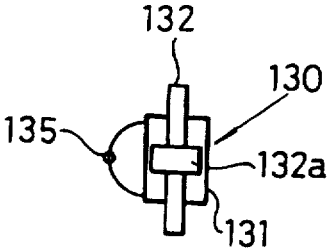
Figure 40:
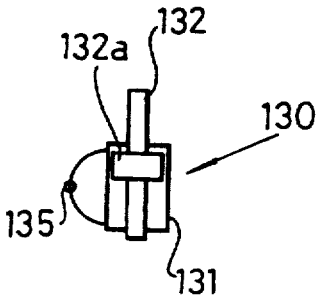
Figure 42:
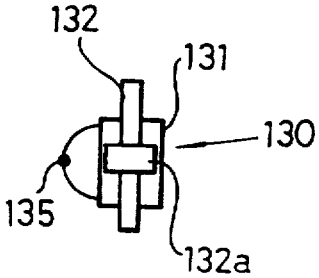

| load device | normal time | earthquake or wind: low damping coefficient or free | earthquake or wind: high damping coefficient or lock |
|---|---|---|---|
| deformed condition of building | FIG. 37 | FIG. 39 | FIG. 41 |
| condition of device | FIG. 38 | FIG. 40 | FIG. 42 |
| | — | Since the switch valve is almost opened, the piston moves without much resistance. | Since the switch valve is almost closed, the piston moves while it receives much resistance. |
| δ | — | large | small |
| Δl | — | large | small |
| T | — | long | short |
| N | 0 | small | large |
| remarks | — | The inside steel pipe is not so much effective, the stiffness is soft and the natural period becomes longer. | The inside steel pipe is sufficiently effective, the stiffness is hard and the natural period becomes shorter. |

δ: horizontal deformation (uppermost portion)
Δl: expansion and contraction of outer post
T: primary natural period of building
N: axial force of inside steel pipe As shown in FIGS. 37 and 38, in the normal time when the vibrational disturbance hardly occurs, the building is not substantially deformed and the switch valve 135 of the cylinder lock device 130 does not need to be controlled.

FIGS. 39 and 40 show the case where the switch valve 135 is fully opened or almost opened. In this case, the inside steel pipe 121 is hardly effective and the natural period becomes longer. The control under such the condition as noted above is carried out for the seismic motion or the like having the short predominant period in the seismic response control system according to the judgement only depending on the unresonance property. Also, when the control is carried out in consideration of the damping property, a large damping force is obtained for a great earthquake having the large vibration level by increasing the opening of the switch valve 135 (the valve 135 is almost opened) of the cylinder lock device 130.

FIGS. 41 and 42 show the case where the switch valve 135 is fully closed or almost closed. In this case, the inside steel pipe 121 is sufficiently effective and the natural period becomes shorter. The control in such the condition as noted above is carried out for the seismic motion or strong wind having the long predominant period in the seismic response control system according to the judgment only depending on the unresonance property. Also, when the control is carried out in consideration of the damping property, a large damping force is obtained for medium and small earthquake having the small vibration level by reducing the opening of the switch valve 135 (the valve 135 is almost closed) of the cylinder lock device 130.

What is claimed is:

1. In a building structure, means to control the response of the structure to external forces of seismic vibration and/or wind impacting against said structure, comprising: variable stiffness means secured to and bracing said structure; variable damping means having a variable coefficient of damping interposed between said structure and said variable stiffness means; and means to vary the coefficient of damping of said variable damping means responsive to the magnitude of said external forces impacting against said structure.

2. The means of claim 1, including computer means programmed to monitor external forces impacting against said structure and to control said variable damping means by selecting the coefficient of damping for said variable damping means best suited to control the response of said structure to said external forces and by actuating said variable damping means.

3. The means of claim 2 wherein said coefficient of damping is selected to render said structure non-resonant relative to the said monitored external forces.

4. The means of claim 1, wherein said variable damping means comprises: a double acting hydraulic cylinder; a shiftable piston in said hydraulic cylinder dividing said cylinder into two concentrically opposed chambers; a piston rod axially aligned and concentrically mounted in said piston to extend through said opposed chambers; means to secure one end of said piston rod to said structure; means to secure the other end of said rod to said variable stiffness means; first means to pass a hydraulic fluid from one chamber to the other chamber; valve means to control the flow of hydraulic fluid in said first means; and means to control said valve means, whereby the coefficient of damping of said variable damping means is determined by the control of said valve means.

5. The means of claim 4, including second means to pass a hydraulic fluid from one chamber to the other chamber; means to restrict the flow of hydraulic fluid in said second means; said second means comprising a bypass around said valve means in said first means.

6. The means of claim 1, wherein said variable damping means comprises: a hydraulic cylinder; a shiftable piston in said hydraulic cylinder dividing said cylinder into two opposed chambers; a piston rod axially aligned an concentrically mounted in said piston to extend through said opposed chambers; means to secure one end of said piston rod to said structure; means to secure the other end of said rod to said variable stiffness means; an oil pressure line with one end connected to one of said chambers an connected to the inflow side of a variable damping control valve; an oil pressure line connected at one end to the outflow side of said variable damping control valve and at its other end to the other of said chambers; means to pen and to close said variable damping control valve wherein said piston is rendered immovable in said cylinder when said variable damping control valve is closed and movable in said cylinder when said variable damping control valve is open, whereby the coefficient of damping of the variable damping means ia a first preselected value when said variable damping control valve is closed and a second preselected value when said variable damping control valve is open.

7. The means of claim 6, including means to actuate said means to open and to close said variable damping control valve.

8. The means of claim 6, wherein said means to actuate said means to open and to close said variable damping control valve is adapted to sense and to respond to sensed external forces of seismic vibration and/or wind impacting against said structure by controlling the opening and closing of said means to open and to close said variable damping control valve.

9. The means of claim 6, wherein said means to open and to close said variable damping control valve is adapted to pulse said variable damping control valve with pulses of variable time intervals to thereby provide a plurality of selectable coefficients of damping for said variable damping means.

10. The means of claim 9, wherein said means to actuate said means to open and to close said variable damping control valve comprises computer means adapted to sense, to measure, and to evaluate external forces of seismic vibration and/or wind impacting against aid structure and to transmit signals to said means to open and to close said variable damping control valve to provide a coefficient of damping commensurate with the computer-sensed seismic and/or wind forces impacting against said structure.

11. The means of claim 1, wherein said variable stiffness means comprises cross braces secured between selected portions of said structure, and said variable damping means is secured between said cross braces and said structure.

12. The means of claim 1, wherein said structure comprises posts and beams, said variable stiffness means comprises cross braces secured between said posts and beams, and said variable damping means interconnects said cross braces, posts and beams.

13. The means of claim 12, wherein said cross braces are segmented and said variable damping means connects said segmented cross braces.

14. The means of claim 12, wherein said cross braces are of X-shaped configuration, and said variable damping means forms the center of each of said X-shaped cross braces.

15. The means of claim 12, including a quake-resisting wall secured to one of said beams and said variable damping means secured between another of said posts and said quakersisting wall.

16. The means of claim 12, wherein said cross braces comprise a pair of V-shaped members with the apex ends of said members positioned adjacent the midsection of a beam and the opposite ends of said members secured to the opposite ends of a vertically spaced apart beam, and said variable damping means secured between the apex ends of said members and said midsection of said adjacent beam.

17. The means of claim 12, including a U-shaped member secured to the underside of a beam and depending therefrom; a U-shaped member secured to the topside of a beam spaced vertically below said first-mentioned beam and projecting upwardly therefrom, and variable damping means interconnecting said U-shaped members.

18. The means of claim 12, including a structure foundation, resilient means interposed between said structure and said foundation, and variable damping means connected between said structure and said foundation.

19. The means of claim 1, wherein said structure comprises vertical hollow posts; variable stiffness means positioned within said posts; and variable damping means interconnecting said variable stiffness means and said vertical hollow posts.

20. The means of claim 19, wherein said variable stiffness means comprises steel pipe spaced away from the interior walls of said vertical hollow posts.

* * * * *

UNITED STATES PATENT AND TRADEMARK OFFICE

CERTIFICATE OF CORRECTION

PATENT NO. : 5,036,633

DATED : August 6, 1991

INVENTOR(S) : Kobori et al

It is certified that error appears in the above-identified patent and that said Letters Patent is hereby corrected as shown below:

Column 21, line 27, "an" should be --and--.
line 31, "pen" should be --open--.

Signed and Sealed this

Eighteenth Day of February, 1992

*Attest:*

HARRY F. MANBECK, JR.

*Attesting Officer*

*Commissioner of Patents and Trademarks*

UNITED STATES PATENT AND TRADEMARK OFFICE

CERTIFICATE OF CORRECTION

PATENT NO. : 5,036,633

DATED : 08/06/91

INVENTOR(S) : Takuji Kobori, et al

It is certified that error appears in the above-indentified patent and that said Letters Patent is hereby corrected as shown below:

The title page should be deleted to be replaced with the attached title page.

Drawing sheets 1 of 13 - 13 of 13, should be deleted to be replaced with the attached drawing sheets.

Columns 1 - 22 should be deleted to be replaced with the attached columns 1 - 20.

Signed and Sealed this

Third Day of May, 1994

Bruce Lehman

*Attest:*

BRUCE LEHMAN

*Attesting Officer*

*Commissioner of Patents and Trademarks*

US005036633A

United States Patent [19]

Kobori et al.

[11] Patent Number: 5,036,633

[45] Date of Patent: Aug. 6, 1991

[54] VARIABLE DAMPING AND STIFFNESS STRUCTURE

[75] Inventors: Takuji Kobori; Motoichi Takahashi; Tadashi Nasu; Naoki Niwa; Narito Kurata; Junichi Hirai; Yoshinori Adachi; Koji Ishii, all of Tokyo, Japan

[73] Assignee: Kajima Corporation, Tokyo, Japan

[21] Appl. No.: 475,818

[22] Filed: Feb. 6, 1990

[30] Foreign Application Priority Data

| | | | |
|---|---|---|---|
| Feb. 7, 1989 | [JP] | Japan | 1-27901 |
| Feb. 7, 1989 | [JP] | Japan | 1-27902 |
| Feb. 7, 1989 | [JP] | Japan | 1-27903 |
| Feb. 7, 1989 | [JP] | Japan | 1-27904 |
| Feb. 23, 1989 | [JP] | Japan | 1-43565 |
| Mar. 14, 1989 | [JP] | Japan | 1-61237 |
| Mar. 23, 1989 | [JP] | Japan | 1-71182 |

[51] Int. Cl.[5] ..... E04H 9/00

[52] U.S. Cl. ..... 52/1; 52/167 DF

[58] Field of Search ..... 52/1, 167 DF

[56] References Cited

U.S. PATENT DOCUMENTS

| | | | |
|---|---|---|---|
| 4,429,496 | 2/1984 | Masri | 52/1 |
| 4,587,773 | 5/1986 | Valencia | 52/167 DF |
| 4,799,339 | 1/1989 | Kobori et al. | 52/1 |
| 4,841,685 | 6/1989 | Masri et al. | 52/1 |
| 4,890,430 | 1/1990 | Kobori et al. | 52/167 |
| 4,901,486 | 2/1990 | Kobori et al. | 52/167 DF |
| 4,922,667 | 5/1990 | Kobori et al. | 52/167 DF |
| 4,959,934 | 10/1990 | Yamada et al. | 52/167 R |

*Primary Examiner*—David A. Scherbel
*Assistant Examiner*—Creighton Smith
*Attorney, Agent, or Firm*—James H. Tilberry

[57] ABSTRACT

A variable damping and stiffness structure includes a variable damping device positioned between posts and beams of a structure and variable stiffness elements interconnect the posts and beams. The non-reasonance property and the damping property of the structure are monitored by a computer on the basis of information obtained from sensed disturbances such as earthquakes and high winds. The computer is programmed to control the variable damping device in a manner best suited to reduce the response of the structure to the disturbances.

20 Claims, 13 Drawing Sheets

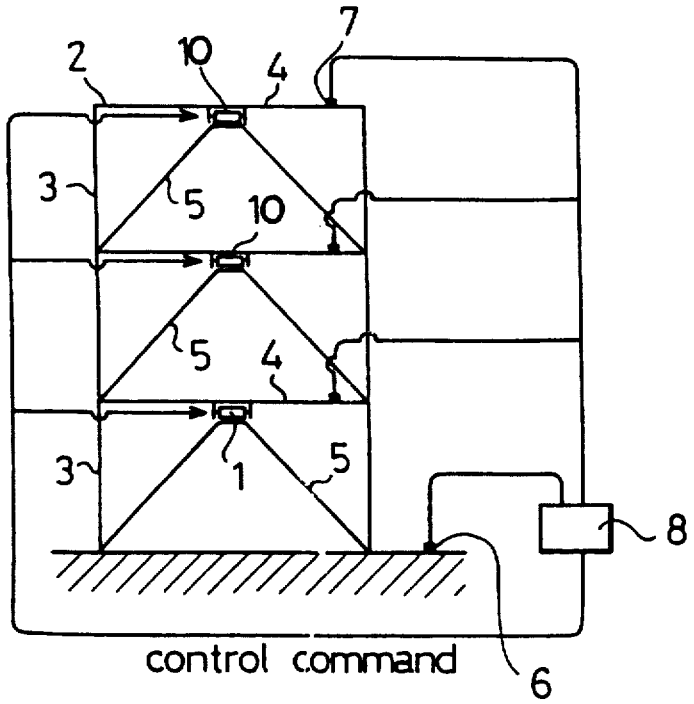

VARIABLE DAMPING AND STIFFNESS STRUCTURE

BACKGROUND OF THE INVENTION

1. Field of the Invention

This invention relates to a variable damping and stiffness structure having a variable damping device provided in a frame of the structure and interconnecting a frame body and a variable stiffness element, or variable stiffness elements themselves, provided in the frame, wherein an external vibrational force or disturbance like an earthquake and/or wind is controlled by a computer according to the vibration of the structure to thereby reduce the response of the structure.

2. Description of the Prior Art

The assignee of the present application has proposed various active seismic response control systems and variable stiffness structures (for example, Japanese Patent Laid-open No. Sho 62-268479 and U.S. Pat. No. 4,799,339), in which a variable stiffness element in the form of a brace and a wall or the like is incorporated into a post-beam frame of the structure, and the stiffness of the variable stiffness element itself or the connecting condition of a frame body and the variable stiffness element is varied responsive to a computer analysis of an external vibrational force like an earthquake and wind so that the stiffness of the structure is varied to render the structure non-resonant relative to the external vibrational force to achieve the safety of the structure.

Prior art active seismic response control systems observe mainly the relationship between a predominant period of the seismic motion and a natural frequency (usually, the primary natural frequency is taken into consideration) of a structure, wherein a resonance phenomenon is avoided by changing the natural frequency of the structure relative to the predominant period of the seismic motion to thereby reduce the magnitude of the response of the structure.

However, since seismic vibration is unpredictable and may vary randomly, it is conceivable that the conventional active seismic response control system may not necessarily carry out the optimal control in the case where the predominant period is indistinct or a plurality of predominant periods are present.

SUMMARY OF THE INVENTION

While the conventional active seismic response control system deals with the non-resonant physical properties of a structure, the present invention provides a variable damping device between a frame body and a variable stiffness element to control the damping coefficient, whereby the vibration is more effectively managed.

According to the present invention, a damping device capable of varying the damping coefficient of the structure is interposed between the frame body of the structure and a variable stiffness element, or the device may be secured within the frame of the structure, per se. Damping corresponding to the vibration of the frame structure is obtained by computer means to actively vary the damping coefficient of the variable damping device to reduce the response of the structure to an external vibrational force. Thus, the inventive variable damping device not only functions to vary the stiffness of the frame structure between locked and unlocked conditions, but also functions to vary the conditions of locking and unlocking the frame structure by computer-controlled changing of the damping coefficient of the variable damping device. In this manner, the natural period of the frame structure can be changed to more effectively counteract destructive seismic vibrations.

The variable damping device is designed to provide two damping coefficients, $C_1$, $C_2$, by means of a connecting device, hereinafter referred to as a cylinder lock device 10, FIG. 3, in which a cylinder 11 is connected to a variable stiffness element like a structural brace, and a piston rod 12 is connected to the frame body. The cylinder lock device 10 has a switch valve 15 provided in an oil line 14 interconnecting a pair of oil pressure chambers 13 and **13*a*, respectively, located on opposite sides of the piston 12*a*, wherein the variable damping device is controlled either to the unlocked side, first condition, or the locked side, second condition, by the opening or closing operation of the switch valve 15. The oil line 14 is provided with an orifice 16**, whereby first damping coefficient $C_1$, in the first condition, is realized by preselecting the size of the orifice.

Referring to a second damping coefficient $C_2$, a second oil line 17 is provided as a bypass for the switch valve 15, and an orifice 18 is provided in the second oil line 17, whereby the second damping coefficient $C_2$, in the second condition, is realized by preselecting the size of the orifice 18.

Figure 4:
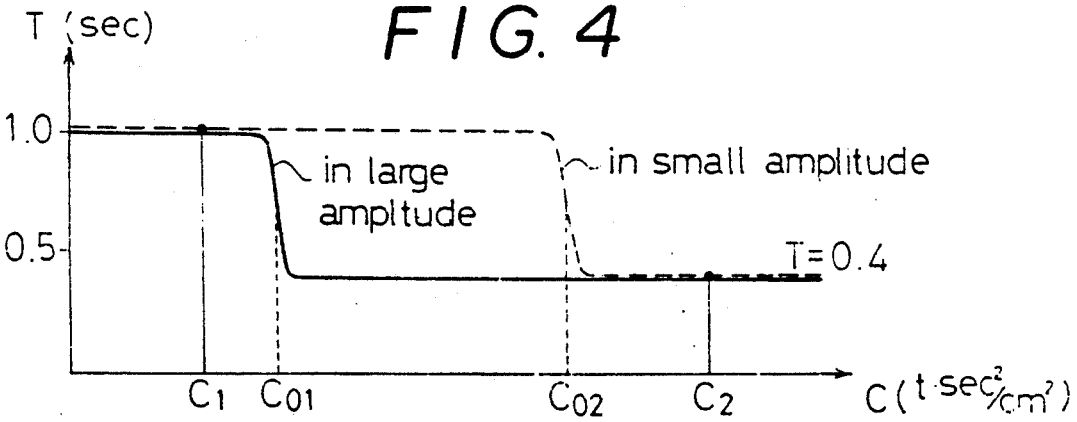
FIGS. 4 and 5 are graphs for explaining the frame characteristics in a structure, to which the first active seismic response control system is applied, respectively.

In the cylinder lock device 10, the damping force is proportional to the relative speed of the piston rod 12 to the cylinder 11. The frame characteristics in this case are shown in FIGS. 4 and 5, in which the solid line represents the frame characteristics in large amplitude and the broken line represents the frame characteristics in small amplitude. That is, the frame using the cylinder lock device shows different characteristics depending on the magnitude of vibration (for example, amplitude). Graphs in FIGS. 4 and 5 show the frame characteristics in two kinds of vibrational levels ($\pm 0.5$ cm and $\pm 3.0$ cm in amplitude between stories), and the natural period of the frame varies in a value of the damping coefficient C (damping coefficient $C_{01}$, of which the damping factor h reaches the maximum at the large vibration level, and damping coefficient $C_{02}$, of which the damping factor h reaches the maximum at the small vibration level) of the cylinder lock device, in which the damping factor h of the frame reaches the maximum.

Assuming that the damping coefficient in the upper limit of the vibration level to be controlled is equal with $C_{01}$ of the above-mentioned damping coefficient and the damping coefficient in the lower limit of the vibration level to be controlled is equal with $C_{02}$ of the above-mentioned damping coefficient, and when the period in such a range is always variable, as is apparent from FIG. 4, the first and second damping coefficients $C_1$, $C_2$ will do if these coefficients $C_1$, $C_2$ are defined respectively as follows:

$$C_1 < C_{01},\ C_2 > C_{02} \ldots \quad (1)$$

Also, as is apparent from FIG. 5, these coefficients $C_1$, $C_2$ are preferably defined as values which deviate slightly from $C_{01}$, $C_{02}$, respectively.

Table 1 shows examples of the damping factor h and the primary natural period of the frame relative to two kinds of defined damping coefficients $C_1$, $C_2$.

TABLE 1

| damping coefficient | magnitude of vibration | h (%) | T (sec) |
|---|---|---|---|
| $C_1$ | small | 10 | 1.0 |
| | large | 25 | 1.0 |
| $C_2$ | small | 30 | 0.4 |
| | large | 10 | 0.4 |

Provided that the selection of $C_1$, $C_2$ varies with the range of the vibration level to be controlled and in the case where a range capable of varying the period may be limited, $C_1$, $C_2$ are not necessarily limited to the range represented in (1).

Further, the variable damping device for giving two kinds of damping coefficients is not limited to the above-mentioned cylinder lock device, but any other variable damping device will do so long as it is capable of setting at least two kinds of damping coefficients to provide a damping force proportional to the relative speed.

The active seismic response control system in this case is comprised of the variable damping device interposed between the frame body and the variable stiffness element, or in the variable stiffness element, and selectively setting one of at least two damping coefficients $C_1$ or $C_2$, as noted above, frequency characteristic analyzing means, response magnitude measuring means, damping coefficient selecting means and control command generating means.

The external vibrational force input to a structure is sensed by a sensor or the like installed in the structure or in the outside, and the predominant period and other frequency characteristics are analyzed by the frequency characteristic analyzing means in a computer program. The actual response magnitude of the structure, or that of the frame body, is sensed by an accelerometer, a speedometer, a displacement meter or like sensors serving as the response measuring means. The property of non-resonance and the damping property of the frame body are estimated and compositely examined with reference to these frequency characteristics and the response amount by the damping coefficient selecting means in a computer program, whereby either one of two of the damping coefficients $C_1$, $C_2$ is selected as the damping coefficient for reducing the response of the structure. That is, where the predominant period is indistinct and the property of non-resonance cannot be obtained, or where the damping control effect is greater than the non-resonance effect according to the distribution of a period component, the seismic motion is judged by the computer on the basis of the obtained frequency characteristics and response magnitude to select the damping coefficient. Further, the natural period of the frame body, or that of the structure, results in either a long or short period according to the vibration level by selecting the damping coefficient. Thus, the natural period for the property of non-resonance is chosen by selecting the damping coefficient according to the vibration level. The selection of the damping coefficient is made by forwarding the signal generated from the control command generating means to the variable damping device.

The cylinder lock device is capable of varying the damping coefficient at multiple stages, or continuously. As shown in FIG. 15, the cylinder lock device 30 includes a variable size orifice 35 positioned in an oil line 34 interconnecting a pair of oil pressure chambers 33 and 33*a*, respectively, located on opposite sides of a piston 32*a*. The damping coefficients ranging from the small damping coefficient at the unlocked side having the large opening to the large damping coefficient at the locked side having the small opening are adjusted at multiple stages, or continuously, by adjusting the opening of the orifice 35. To control the size of the orifice 35, use is particularly made of a high speed switch valve, or the like, controlled in response to a pulse signal through a pulse generator, or the like. As shown in FIG. 16, the various openings and the various damping coefficients accompanying the change in the opening are realized by varying a valve opening time. The times during which the valves are closed as shown in FIG. 16 are proportional to the damping coefficients $C_1$, $C_2$, $C_3$ in which $C_1 < C_2 < C_3$. Otherwise, the opening may be adjusted by any mechanical means.

In the cylinder lock device 30, the damping force for the frame body is given as a resistance force proportional to the relative speed of the piston rod 32 to the cylinder 31, and the frame body shows the characteristics varying with the magnitude of amplitude of vibration, for example. The frame characteristics in this case are as shown in FIGS. 17 and 18.

FIGS. 17 and 18 show the frame characteristics in five kinds of vibration levels ranging from the large vibration of about several cms per structural story amplitude to the small vibration of about several mms of story amplitude. In the vicinity of values $C_1$, $C_2$, $C_3$, $C_4$ and $C_5$ of the damping coefficient in which the damping factor of the frame in each vibration level reaches the maximum, the natural period (primary natural period) of the frame is varied from the longest natural period $T_1$ to the shortest natural period $T_2$. Also, as is apparent from these graphs, the larger the vibration is, the smaller the damping coefficient of the variable damping device producing the maximum damping effect.

Observing only the damping property, the response of the structure is reduced by adjusting the damping coefficient of the variable damping device according to the vibration level of the frame such that the damping effect of the frame is maximized by utilizing the non-resonant frame physical characteristics.

When the external vibrational force is input to the structure, the response amount of the structure or that of the frame body is sensed by an accelerometer, a speedometer, a displacement meter or like sensors serving as the response measuring means. A large damping property is given to the structure according to the vibration level by the damping coefficient selecting means in the computer program to select a value of the optional damping coefficient C for reducing the response of the structure. The selected value of the damping coefficient C is realized by transmitting control signals to the variable damping device from the control command generating means, that is, by adjusting the opening of the switch valves of the variable damping devices.

With reference to FIG. 18, the mode of non-resonant property is realized, and the response of the structure is reduced in both the non-resonance and damping effect by selecting the damping coefficient to be as large as possible. When the effect of non-resonant property cannot be obtained, in the case where the predominant period of the seismic motion is indistinct, for example, a large damping effect can nevertheless be obtained by selecting the damping coefficient $C_i$ and maximizing the damping factor of the frame for the damping coefficient of the variable damping device.

The active seismic response control system in this case is comprised of the variable damping device interposed between the frame body and the variable stiffness element, or in the variable stiffness element, and capable of varying the damping coefficient as noted above, frequency characteristic analyzing means, response amount measuring means, non-resonant property estimating means, damping property estimating means, damping coefficient selecting means, and control command generating means.

The external vibrational force input to the structure is sensed by sensors installed in the structure or on the outside thereof, and the predominant period and other frequency characteristics are analyzed by the frequency characteristic analyzing means in the computer program. On the other hand, the actual response of the structure or that of the frame body is sensed by an accelerometer, a speedometer, a displacement meter, or like sensors, serving as the response magnitude measuring means. The non-resonant property and the damping property of the frame body are estimated by the non-resonant property estimating means and the damping property estimating means in the computer program with respect to the frequency characteristic and the response amount, so that the damping coefficient for reducing effectively the response of the structure is selected by judging compositely the non-resonant property and the damping property of the frame body. For example, the non-resonant property is estimated with respect to two kinds of natural periods, $T_1$, $T_2$ given to the frame body by the variable damping device. When the effect on the non-resonant property due to either natural period is judged to be larger, the damping coefficient is selected to increase the damping property as much as possible. If the predominant period is indistinct and non-resonance cannot be provided, a damping coefficient is selected to provide maximum damping to the structure. The selected damping coefficient is obtained by forwarding to the variable damping device the control command generated from the command generating means.

OBJECTS OF THE INVENTION

A primary object of the present invention is to reduce the response of a structure to seismic vibration by varying the damping coefficient of a connecting device interposed between a frame body and a variable stiffness element, to estimate and control the resonance and damping properties of the structure, and to insure the safety of the structure.

Another object of the present invention is to vary the connecting condition of the variable stiffness element and the variable damping device to reduce the magnitude of response of the structure when impacted with seismic vibration.

A further object of the present invention is to simultaneously estimate and control the resonance property and the damping property of the structure relative to a given seismic input disturbance and to control the response of the structure to the disturbance.

A still further object of the present invention is to control not only the non-resonant property but also the damping property of a structure responsive to seismic disturbance, even when the disturbance is minimal.

A yet further object of the present invention is to provide a variable damping device suitably used for controlling the vibration of a structure by estimating the resonance property and the damping property of the structure.

While the invention itself is defined with particularity in the appended claims, the above and other objects, advantages, and features of the invention will become more apparent by reference to the following detailed description thereof taken in conjunction with the accompanying drawings.

BRIEF DESCRIPTION OF THE DRAWINGS

FIG. 1 is a schematic view in elevation showing a variable damping and stiffness structure, to which a first active seismic response control system is applied according to the present invention;

FIG. 2 is a flow chart in accordance with the first active seismic response control system schematically shown in FIG. 1;

FIG. 3 is a cylinder lock device used in the first active seismic response control system shown in FIG. 1;

FIGS. 4 and 5 are graphs showing structural frame characteristics to which a first inventive active seismic response control system is applied;

FIGS. 6 through 12 are graphs showing the relationship between the seismic motion characteristics of the control in accordance with the inventive active seismic response control system and the response magnitude obtained with two damping coefficients, respectively;

FIG. 13 is a schematic view in elevation showing a variable damping and stiffness structure, to which a second active seismic response control system is applied according to the present invention;

FIG. 14 is a flow chart in accordance with the second active seismic response control system schematically;

FIG. 15 is a cylinder lock device as an embodiment of a variable damping device used in the second and third active seismic response control systems shown in FIG. 13;

FIG. 16 is a wave chart showing the relationship between the damping coefficient of the variable damping device and pulse signals in the case where the opening of an orifice using a high speed switch valve is adjusted in response to the pulse signal to be controlled by a valve opening time;

FIGS. 17 and 18 are graphs for explaining the frame characteristics of a structure, to which the second and third active seismic response control systems are applied, respectively;

FIG. 19 is a schematic view showing a variable damping and stiffness structure, to which the third active seismic response control system according to the present invention is applied;

FIG. 20 is a flow chart in accordance with the third active seismic response control system;

FIG. 21 is an oil pressure circuit diagram showing an embodiment of the cylinder lock device to be used in the first active seismic response control system;

FIG. 22 is an oil pressure circuit diagram showing an embodiment of the cylinder lock device used in the second and third active seismic response control systems;

FIGS. 23 through 30 are schematic views showing the positions in which the variable damping device may be applied to the frame of the variable damping and stiffness structure according to the present invention;

FIG. 31 is a fragmentary vertical sectional view showing an embodiment of the variable damping and stiffness structure subjected to bending deformation control;

FIG. 32 is a sectional view taken along the line 32—32 of FIG. 31;

FIG. 33 is a sectional view taken along the line 33—33 of FIG. 31;

FIG. 34 is an elevational view showing the outline of a building having a variable damping and stiffness structure;

FIG. 35 is a plan view of the building of FIG. 34;

FIG. 36 is a sectional view of a cylinder lock device serving as the variable damping device;

FIG. 37 is a schematic elevational view showing a building under normal conditions of repose;

FIG. 38 is a schematic view of a cylinder lock device in a neutral position;

FIG. 39 is a schematic view of a building with low damping capacity yielding to the forces of earthquake and/or wind;

FIG. 40 is a schematic view of a cylinder lock device in the unlocked position;

FIG. 41 is a schematic elevational view of a building with high damping capacity subjected to the same forces of earthquake and/or wind as the building of FIG. 39; and FIG. 42 is a schematic view showing the cylinder lock device used in the building of FIG. 41.

DETAILED DESCRIPTION OF PREFERRED EMBODIMENTS

The several embodiments of a control system used for a variable damping and stiffness structure according to the present invention will now be described.

Active seismic response control system 1

In this system, a variable damping device having two selectable damping coefficients $C_1$ and $C_2$ is interposed between a frame body and a variable stiffness element or in the variable stiffness element, per se. The non-resonant property and the damping property of a structure are evaluated by computer means to control the vibration of the structure by varying the connecting condition of the variable damping device with the structure.

In a first embodiment of the invention, FIG. 1 schematically shows an active seismic response control system for a structure according to the present invention. A variable damping device, such as the cylinder lock device 10 shown in FIG. 3, is interposed between a frame body 2 comprising posts 3 and beams 4 and an inverted v-shaped brace 5 provided as a variable stiffness element and incorporated in the frame body 2 of each story. The input seismic vibration and the response of the structure, as measured by indicia such as amplitude, speed, and/or acceleration, are respectively sensed by an input sensor 6 and a response sensor 7. The damping coefficient of the variable damping device 10, as a function of the input seismic vibration and the structure response is obtained by a computer 8 to output a control command.

FIG. 2 illustrates the above-described process as follows:

(1) A vibration level for the control is set. For example, ±0.5 to ±3.0 cm of story deformation, and 1 to 25 kine (cm/sec) of speed.

(2) The frame characteristics in the upper and lower limits of the set vibration range are noted. For example, the variation of period and damping of the frame body due to the damping coefficient of the variable damping device.

(3) The period shall be able to vary in the set vibration level, and further the damping coefficient $C_1$, $C_2$ of the variable damping device capable of additionally producing the effect on damping to the frame as great as possible shall be selected so that either $C_1$ or $C_2$ is selected according to the control command.

(4) The damping property is estimated (feed-back control) according to the response of the structure, and the non-resonant property is estimated (feed-forward control) according to the seismic motion characteristics (predominant period) so that the composite control becomes possible.

(5) In a small vibration (wind and small earthquake), the damping coefficient $C_2$ for producing the largest effect on damping in the small vibration level is normally selected.

Table 2 shows a summary of control means in the seismic motion characteristics corresponding to FIGS. 6 through 12 as the embodiments of control. Further, in FIGS. 6 through 12, the ordinate represents response values, the abscissa represents periods, the solid line represents the response spectrum of a seismic motion, the dot-dash line represents the response value when the damping coefficient $C_1$ is selected, the broken line represents the response value when the damping coefficient $C_2$ is selected, the black circle represents the response value in the selected damping coefficient, and the white circle represents the response value in the other damping coefficient not selected.

TABLE 2

| Number | Vibration level | Seismic motion characteristics and others | Selected damping coefficient | Damping factor of frame, primary natural period and comments |
|---|---|---|---|---|
| 1 | small | FIG. 6 | $C_2$ | h = 30%, T = 0.4 sec<br>This case has the largest effect in damping. Unresonance is impossible |
| 2 | small | FIG. 7 | $C_1$ | h = 10%, T = 1.0 sec<br>This case is effective in unresonance more than damping |
| 3 | small | FIG. 8 | $C_2$ | h = 30%, T = 0.4 sec<br>This case is effective in damping more than unresonance |
| 4 | small | FIG. 9 | $C_2$ | h = 30%, T = 0.4 sec<br>This case has the effect both in damping and unresonance |
| 5 | large | FIG. 10 | $C_1$ | h = 25%, T = 1.0 sec<br>This case has the same effect as that in No. 1 |
| 6 | large | FIG. 11 | $C_2$ | h = 10%, T = 0.4 sec<br>This case has the same effect as that in No. 2 |
| 7 | large | FIG. 12 | $C_1$ | h = 25%, T = 1.0 sec<br>This case has the same effect as that |

TABLE 2-continued

| Number | Vibration level | Seismic motion characteristics and others | Selected damping coefficient | Damping factor of frame, primary natural period and comments |
|---|---|---|---|---|
| | | | | in No. 4, while the damping coefficient is $C_1$. |

Active seismic response control system 2

In a second embodiment of the invention, FIG. 13 schematically shows the outline of a variable damping and stiffness structure. A variable damping device 21 is interposed between a frame body 22, comprising posts 23 and beams 24, and an inverted V-shaped brace 25 provided as a variable stiffness element and incorporated in the frame body 22 of each story. The response of the structure, measured by indicia such as amplitude, speed, acceleration or the like in an earthquake is sensed by a response sensor 26 provided in the structure, and the optimal damping coefficient of the variable damping device 21 corresponding to the response condition, i.e., vibration level, is obtained by a computer 28 to generate a control command. FIG. 14 shows the flow of the process in the above control.

In a cylinder lock device 30 making use of oil pressure, as shown in FIG. 15, a damping force relative to the frame body is given as a resistance force proportional to the power of the relative speed of a piston rod 32 to a cylinder 31. The frame characteristics in this case are as shown in FIG. 18. The graph in FIG. 18 shows the frame characteristics in five kinds of vibration levels ranging from the large vibration having several cms of story amplitude to the small vibration having several mms of story amplitude, in which reference numeral C represents the damping coefficient of the variable damping device and h represents the damping factor of the frame. As is apparent from this graph, the larger the vibration is, the smaller is the damping coefficient C of the variable damping device producing the maximum effect on damping.

In this embodiment, the damping coefficient of the variable damping device is adjusted according to the vibration level of the frame by making use of the frame characteristics such that the damping effect of the frame reaches the maximum, as the response of the structure is reduced.

More particularly, the control is carried out as follows:

(1) First, the magnitude of vibration (amplitude, speed, acceleration or the like) of the structure, the damping coefficient C of the variable damping device and the damping effect h of the frame are measured in relation to the control.

This corresponds to the frame characteristics shown in FIG. 5 which are measured with respect to a plurality of vibration levels, and the damping coefficients $C_1, \ldots, C_n$, giving the maximum damping effect h of the corresponding structure or the frame, are obtained with respect to the levels ranging from the large vibration level $L_1$ to the small vibration level $L_n$.

(2) The damping coefficient C minimizing the vibration of the structure is continuously calculated by the computer on the basis of the above characteristics to control the variable damping device. This control results in the feed-back control since the variable damping device is controlled while the vibrational condition of the structure is monitored.

The control in the system 2 is thus fed back according to the response amount of the structure to be relatively simply carried out by previously comparing the relationship between the vibration level and the damping coefficient.

Active seismic response control system 3

In a third embodiment of the invention, FIG. 19 schematically shows the outline of a variable damping and stiffness structure. The input seismic vibration and the response of the structure, such as measured by amplitude, speed, and/or acceleration, are sensed respectively by an input sensor 56 and a response sensor 57, and the damping coefficient of a variable damping device 51 according to the seismic vibration characteristics. The response reaction is obtained by a computer 58 to generate a control command. FIG. 20 shows the flow of the process in the above control.

The variable damping device 51 is the same as the variable damping device in the second embodiment of the system. However, as is apparent from FIGS. 17 and 18, in respective vibration levels, the natural period (primary natural period) of the frame is also varied from the long natural period $T_1$ to the short natural period $T_2$ in the vicinity of values $C_1$, $C_2$, $C_3$, $C_4$ and $C_5$ of the damping coefficients maximizing the damping factor h of the frame.

Assuming that the damping coefficient maximizing the damping factor h of the frame in a certain vibration level is $C_1$ as above mentioned, the natural period of the frame results in the longer natural period $T_1$ in the damping coefficient $C_{i1}=C_i-a(a>0)$ which is somewhat smaller than the damping coefficient $C_i$ as shown in FIG. 17, while in the damping coefficient $C_{i2}=C_i-(b>0)$ which is somewhat larger than the damping coefficient $C_i$, the natural period of the frame results in the shorter period $T_2$. This is collated with FIG. 18 showing the relationship between the damping coefficient C of the variable damping device and the damping factor h of the frame. The natural period, which is advantageous for the frame having either natural period $T_1$ or $T_2$ in the mode of non-resonance property, is realized, and the response of the structure is reduced in both modes of non-resonance and damping effect by selecting the damping coefficient best calculated to make the damping effect of the frame as large as possible (by making the aforementioned a or b as small as possible within a range of satisfying the requirements of the natural period). However, when the predominant period of the seismic motion is indistinct and the effect on the non-resonant property is minimal, a large damping effect is obtained by selecting the damping coefficient $C_1$, thereby maximizing the damping factor h of the frame as the damping coefficient of the variable damping device.

Hereinafter this effect will be described in relation to the flow chart shown in FIG. 20.

The external vibrational force input to the structure is detected by sensors provided on or in the structure to analyze the predominant period and other frequency characteristics. On the other hand, the actual response of the structure, or that of the frame body, is detected by sensors such as an accelerometer, a speedometer, and/or a displacement meter. The non-resonant property and the damping property of the frame body are calculated by the computer with reference to the frequency characteristics and the response amount to simultaneously judge the frequency characteristics and the amount of structure response, so that the damping coefficient for effectively reducing the response of the structure is selected. For example, the non-resonant property in two kinds of natural periods $T_1$, $T_2$ given to the frame body by the variable damping device can be calculated. When the effect of the non-resonant property, due to either natural period, is sensed to be large, the damping coefficient for obtaining the desired natural period is selected within a range to give the maximum damping property. When the predominant period is indistinct, and it is not possible to attain a non-resonant condition, the damping coefficient giving the maximum damping to the structure is selected in consideration of only the damping property. The damping coefficient is computer-selected for the variable damping device by control command from the computer control command generating means to the variable damping device.

More particularly, the control is carried out as follows:

(1) First, the magnitude (amplitude, speed, acceleration or the like) of the vibration of the structure, the damping coefficient C of the variable damping device, the damping effect h of the frame and the period T are sensed in relation to the control.

This, for example, corresponds to the frame characteristics shown in FIGS. 17 and 18 sensed in a plurality of vibration levels. The damping coefficients $C_1, \ldots C_n$, giving the maximum damping factor h for the corresponding structure or the frame, are obtained ranging from the large vibration level $L_1$ to the small vibration level $L_n$.

(2) The damping coefficient C of the variable damping device is continuously calculated by the computer such that the vibration of the structure is minimized on the basis of the commands to control the variable damping device.

(3) The damping coefficient C of the variable damping device is selected on the basis of the following three points:

i. The non-resonance of the structure is offset against the seismic motion (feed-forward control). The damping coefficient C, capable of obtaining natural period non-resonance for the structure to make the response of the structure less, is selected on the basis of the frequency analysis of the seismic motion.

ii. The damping coefficient C, making the damping effect of the frame body as great as possible, is selected according to the vibration condition of the structure (feed-back control), provided it is selected within the extent of obtaining the natural period set in (i).

iii. When the effect due to the non-resonance of the structure is small, the damping coefficient C, maximizing the damping effect of the frame body, is selected.

Table 3 summarizes the control in accordance with the third embodiment of the invention, corresponding to the frame characteristics shown in FIGS. 17 and 18.

TABLE 3

| magnitude of vibration | kind of line | seismic motion characteristics | optimal damping coefficient |
|---|---|---|---|
| large (1) | solid line | T = 0.4 | $C_{1-1}$ |
| | | T = 1.0 | $C_{1-2}$ |
| small (4) | two dots-chain line | T = 0.4 | $C_{4-1}$ |
| | | T = 1.0 | $C_{4-2}$ |
| medium (2) | dotted line | same | $C_2$ |

On Table 3, numerals in parentheses in the column of the magnitude of vibration represent the vibration levels shown in FIGS. 17 and 18 in the order from the smaller level to the larger level. Also, the seismic motion characteristics of Table 3 show the natural period of smaller response spectrum out of two kinds of natural periods given by the variable damping device.

That is, on Table 3, when the vibration level is large (1) and the period component is 0.4 seconds for the seismic motion characteristics, the damping coefficient $C_{1-1}$ shown in FIGS. 17 and 18 is selected. When the period component is 1.0 second, the damping coefficient $C_{1-2}$ is selected. Similarly, when the vibration level is small (4) and the period component is 0.4 seconds for the seismic motion characteristics, the damping coefficient $C_{4-1}$ is selected, and when the period component is 1.0 second, the damping coefficient $C_{4-2}$ is selected. The lowermost row on Table 3 shows the case where there is little difference in the response spectrum between two kinds of natural periods, i.e., 0.4 seconds and 1.0 second. In this case, the damping coefficient $C_2$, giving the maximum damping property to the frame, is selected.

Next will be described an embodiment of the variable damping device used in each of the active seismic response control systems 1 to 3.

FIG. 21 schematically shows an embodiment of an oil pressure circuit of a variable damping device 61 used in the active seismic response control system 1. As shown in the drawing, a device body includes left and right oil pressure chambers 65 and **65*a* located at the left and right of a piston 63 mounted on a reciprocating rod 64 in a cylinder 62. Pressurized oil in the left and right oil pressure chambers 65 and 65*a* is confined or adapted to flow by a change-over valve 70 used for high volume flow, so that the piston 63** is either immobilized or moved to the left or to the right.

The cylinder 62 may be connected to the frame body of the structure, and the rod 64 may be connected to a variable stiffness element. In the alternative, the rod 64 may be connected to the frame body and the cylinder may be connected to the variable stiffness element.

The left and right oil pressure chambers 65 and **65*a* are provided respectively with left and right outflow blocking check valves 66 and 66*a* for blocking the outflow of pressurized oil from the respective oil pressure chambers 65 and 65*a* and left and right inflow blocking check valves 67 and 67*a* for blocking the inflow of pressurized oil into the respective oil pressure chambers 65 and 65*a*. An inflow oil line 68 is provided for interconnecting the left and right outflow blocking check valves 66 and 66*a*. An outflow oil line 69 is provided for interconnecting the left and right inflow blocking check valves 67. Oil lines 68 and 69 are secured to the body of the cylinder 62**.

A change-over valve 70 for high volume flow is provided in the interconnecting position of the inflow path 68 and the outflow path 69 and has an inlet port 72 and an outlet port 73 and a back pressure port 74 provided on the end of the valve remote from the inlet port 72. A shut-off valve 71, for blocking the flow of pressurized oil toward the back pressure port 74, is provided in an oil line on the side of the back pressure port 74. Oil pressure may therefore be applied at high speed or be instantly shut off.

Further, according to the present invention, an oil line 76 is provided for bypassing pressurized oil through throttle orifice 76a when the high volume change-over valve 70 is closed. The damping coefficient is then varied from the first damping coefficient $C_1$ under the opened condition to the second damping coefficient $C_2(>C_1)$ under the throttled condition.

More particularly, the outflow path 69 is provided with a first orifice 75. By properly designing the opening of the orifice 75, the predetermined first damping coefficient $C_1$ is obtained when the high volume flow change-over valve 70 is open. By properly designing the throttle orifice 76a in the bypass in oil line 76, the predetermined second damping coefficient $C_2$ is obtained when the high volume changeover valve 70 is closed.

Next will be described the operation of the variable damping device 61.

(1) High volume change-over valve is open

When the shut-off valve 71 is opened, the piston 63 is moved to the left in FIG. 21, so that the pressurized oil of the left oil pressure chamber 65 flows through the inflow blocking check valve 67 and the outflow path 69 to push up the large flow change-over valve 70.

Since the left outflow blocking check valve 66 and the right inflow blocking check valve 67a are closed due to the pressurized oil, the pressurized oil flows from the high volume change-over valve 70 through the inflow path 68 and the right outflow blocking check valve 66a. Thus, the oil pressure passes from the left oil pressure chamber 65 to the right oil pressure chamber 65a to move the piston 63 to the left. The orifice 75 in the outflow path 69 functions to meter the flow of pressurized oil to provide the predetermined small damping coefficient $C_1$.

(2) High volume change-over valve is closed

If leftward pressure is exerted against piston 63 when valve 71 is closed, back pressure between valve 71 and back pressure port 74 locks valve piston 70a in the closed position, thereby redirecting oil pressure through throttle orifice 76a to obtain damping coefficient $C_2$.

The same result obtains when the rightward pressure is exerted against piston 63.

When the variable damping device 61 is secured between a frame body and a variable stiffness element, the damping force for the frame body is given as a resistance ($P=cv^r$) approximately proportional to the power of the relative speed of the piston 63 to the cylinder 62 and, as mentioned above, the frame body shows the different characteristics depending on the magnitude (for example, amplitude) of vibration.

The shut-off valve 71 is switched between opening and closing positions by the use of a solenoid 77. Further, as shown in FIG. 21, an accumulator 78 communicating with the inflow path 68 is mounted on the cylinder 62. The accumulator serves as an oil reservoir for maintaining oil pressure in the cylinder 62 in the event of an oil leak; to prevent the oil from mixing with bubbles; and to compensate for a volume change due to a change of temperature and/or the compression of the oil in the system.

FIG. 22 shows an embodiment of an oil pressure circuit of a variable damping device 81 used in each of the active seismic response control systems 2 and 3. As shown in the drawing, the device includes left and right oil pressure chambers 86 and 86a located on the left and right of a piston 83 mounted on rod 84. Pressurized oil in the left and right oil pressure chambers 86 and 86a is confined or caused to flow by a valve 92b, so that the piston 83 is fixed or moved to the left and right.

The cylinder 82 may be connected to a frame structure and rod 84 may be connected to a variable stiffness element, the same as described with respect to the variable damping device of FIG. 21.

The left and right oil pressure chambers 86 and 86a are provided respectively with left and right outflow blocking check valves 88 and 88a for blocking the outflow of pressurized oil from the respective oil pressure chambers 86 and 86a. Left and right inflow blocking check valves 89 and 89a are provided for blocking the inflow of pressurized oil into the respective oil pressure chambers 86 and 86a. An inflow oil line 90 is provided for interconnecting the left and right outflow blocking check valves 88 and 88a, and an outflow oil line 91 is provided for interconnecting the left and right inflow blocking check valves 89 and 89a. Both lines 90 and 91 are secured to the cylinder body 82.

A flow regulating valve 92 is connected to inflow oil line 90 and the outflow oil line 91 to be opened and closed in response to a pulse signal from a pulse generator 100 connected to a control computer 100b, so that the damping coefficient C of the variable damping device 81 can be adjusted by varying the opening of the flow regulating valve 92.

This variable damping device 81 is shown in simplified form in FIG. 15. The FIG. 15 device is either in the rigid or locked mode when valve 35 is closed, or in the unlocked mode when valve 35 is open, thereby providing two values of C. However, in the FIG. 22 device, the valve 92, being pulse generator-computer controlled, is capable of providing a wide range of C values more responsive to the damping requirements of the frame body.

The time intervals of the open and closed modes of the valve 92 are functions of the pulsing provided by the pulse generator. Thus, as shown in FIG. 16, the C coefficient is varied by varying the time interval between pulses. As shown, the $C_1$ coefficient provides a near rigid condition of the variable damping device 81 because of the short time intervals between pulses. As the time interval increases between pulses, such as shown at $C_2$ and $C_3$ of FIG. 16, the variable damping device 81 becomes progressively less rigid.

More particularly, as shown in FIG. 22, the flow regulating valve 92 has an inlet port 95 and an outlet port 96 provided on one end of the valve body, and is comprised of a change-over valve piston 92a, a back pressure chamber 97 provided on the other end of the valve body, and a shut-off valve 92b provided in a bypass flow path 98 interconnecting the inlet port 95 and the back pressure port 97. The shut-off valve 92b is opened and closed in response to the pulse signals sent from the pulse generator on the reception of commands from the computer. The change-over valve 92a is operated with the opening and closing of the shut-off valve 92b.

An accumulator 99 is preferably provided in the inflow path 90 or the outflow path 91 in order to compensate for volume change due to compression of working fluid and change of temperature.

Next will be described the operating sequence of the variable damping device 81.

(1) Flow regulating valve is opened

When the shut-off valve 92b is opened, the piston 83 is moved to the left, so that pressurized oil in the left oil pressure chamber 86 flows through the inflow blocking check valve 89 and the outflow oil line 91 to push up the change-over valve piston 92a.

Since the left outflow blocking check valve 88 and the right inflow blocking check valve 89 are closed due to the pressurized oil, the pressurized oil flows through the inflow oil line 90 and the right outflow blocking check valve 88a. Thus, the pressurized oil flows from the left oil pressure chamber 86 to the right oil pressure chamber 86a to move the piston 83 to the left due to the external force.

When the piston 83 is moved to the right, the pressurized oil flows through the inflow oil line 90 and outflow blocking check valve to left oil pressure chamber 86 to move the piston 83 to the right.

(2) Flow regulating valve is closed

When the shut-off valve 92b is closed and the leftward external force is exerted on the piston 83, the oil pressure to the change-over valve piston 92a is increased. However, since the bypass flow path 98 is shut off by the shut-off valve 92b, thereby building oil pressure at the back pressure port 97, the change-over valve piston 92a is fixed in the closed position to block the movement of piston 83. The same may be said of the case where rightward external force is exerted against the piston 83.

When the variable damping device 81, making use of the oil pressure as noted above, is provided between the frame body and a variable stiffness element, the damping force for the frame body is proportional to the relative speed of the piston 83 to the cylinder 82, and the frame body acquires different damping characteristics depending on the magnitude (for example, amplitude) of vibration.

In the embodiment of the invention shown in FIG. 23, a variable damping device 101 is interposed between a post 103 and beam 104 frame serving as a frame body 102 and an inverted V-shaped brace 105 serving as the variable stiffness element.

In the embodiment of the invention shown in FIG. 24, the variable damping device 101 is interposed between a post 103 and beam 104 frame serving as the frame body 102 and frames 111 and 112 suspended from upper and lower beams 104 and 104a, respectively, to constitute a moment resisting frame as the variable stiffness element.

In the embodiment of the invention shown in FIG. 25, the variable damping device 101 is interposed between a post 103 and beam 104 frame serving as the frame body 102 and a quake resisting wall 112 serving as the variable stiffness element.

In the embodiment of the invention shown in FIG. 26, the variable damping device 101 is mounted on the foundation of a base isolated structure in combination with base isolation rubber such as laminated rubber pad 113. In this case, the variable damping device 101 serves as a damper in the base isolation structure, and the variable stiffness element may be considered to be the foundation of the structure per se.

In the embodiment of the invention shown in FIG. 27, a variable stiffness X-shaped brace 114 is mounted in the post 103 and beam 104 frame serving as the frame body 102. The variable damping device 101 is interposed at the center of the X-shaped brace.

FIG. 28 shows an embodiment of the invention similar to that shown in FIG. 27. While the variable damping embodiment shown in FIG. 27 is horizontally mounted, the variable damping device 101 shown in FIG. 28 is vertically mounted.

The embodiment of the invention shown in FIG. 29 is similar to that shown in FIG. 25, in which the variable damping device 101 is interposed between a post 103 and beam 104 frame serving as the frame body 102 and a quake resisting wall 116 serves as the variable stiffness element. The embodiment shown in FIG. 29 has a novel feature in that the variable damping device 101 is mounted in the space above opening 117 of a doorway or the like.

In the embodiment shown in FIG. 30, the variable damping device 101 is mounted in the center of an X-shaped brace 118 in a post 103 and beam 104 frame, and intermediate horizontal beams 119 and 119a reinforce the frame 103–104.

FIGS. 31 through 42 show embodiments of the present invention applied to structures such as high-rise buildings having large bending deformation. Any of the control systems 1 through 3 may be applied to these structures as the control system.

The vibration of the high-rise building due to forces of earthquake and/or wind includes shearing deformation of the frame due to bending deformation as well as shearing deformation of the posts and beams due to torsional deformation of the posts. Usually, the vibration of the building causes both lateral and torsional bending deformations, and the higher and more slender the building is relative to its width, the greater will be the bending deformation of the entire frame.

Conventional variable stiffness structures often attempt to cope with lateral and torsional deformation by controlling the stiffness of the frame on every story. To do so, a complicated control is necessary, and a satisfactory control is not always obtained.

In the subject invention, a rod-like control member extending vertically over at least several stories of the building is provided along a post of the building. The upper and lower portions of the control member are respectively connected to portions of the building, preferably the uppermost and lowermost portions. The variable damping device is provided near the end of the control member and adapted to control the stiffness or the damping force of the building by controlling the bending deformation against vibrational disturbances such as earthquake and/or wind.

Referring to FIGS. 31 through 33, an interior steel pipe 121 serving as the control member is placed within an exterior steel pipe 122 constituting an outer post 122a of a high-rise building. The interior steel pipe 121 has the uppermost and lowermost portions respectively rigidly connected to cruciform connecting webs 126 and base plates 125. The axial force of the exterior steel pipe 122 at the uppermost portion is transmitted to the interior steel pipe 121. The axial force of the interior steel pipe 121 at the lowermost portion is transmitted to the foundation.

Also, as shown in FIG. 33, the interior steel pipe 121 at the reference story is separated from the cross brace plate 124 to permit the axially relative movement of the interior steel pipe 121 according to the mode of a cylinder lock device 130 provided adjacent and connected to the lower portion of the interior steel pipe 121.

FIGS. 34 and 35 show the elevation and plan views of a building, respectively. In this embodiment, the double-steel pipe structure shown in FIGS. 31 through 33 is applied to only the outer posts 122*a*, and normal posts 122*b* are used inside of outer posts 122*a*. The cylinder lock device 130 is mounted on the first story portions of the outside posts 122*a*.

FIG. 36 is a conceptual schematic view of the cylinder lock device 130 corresponding to that shown in FIG. 15. A double-rod type piston 132*a* is inserted into a cylinder 131 and a switch valve 135 is provided in an oil line 134 for interconnecting left and right oil pressure chambers 133 and 133*a* located on the left and right of the piston 132*a*. The damping and resistance forces can be varied actively by controlling the opening of the switch valve 135 on multiple stages. Also, when the opening of the switch valve 135 is selected between the fully opened condition and the fully closed condition of the opening, one of two C coefficients is obtained. The damping force is proportional to the relative speed of the piston 132*a* to the cylinder 131.

This cylinder lock device 130 is so connected to the interior steel pipe 121 that the motion of the post 122*a* due to its expansion and contraction results in the relative displacement of the piston 132*a* to the cylinder 131 of the cylinder lock device 130.

When the cylinder lock device 130 has two modes, i.e., locked or unlocked, the non-resonance property of the building can be controlled by allowing the post to be expanded and contracted or by restraining the post from being expanded or contracted. Also, the cylinder lock device can be controlled in consideration of the damping property or both the non-resonance property and the damping property of the building by controlling the switch valve 135 at multiple stages or providing an orifice having the proper opening to adjust the damping coefficient of the cylinder lock device 130.

The following table (Table 4) and FIGS. 37 through 42 summarize the relationship between the deformed condition of the building and the condition of the cylinder lock device 130 or the like.

TABLE 4

| load / device | normal time | earthquake or wind: low damping coefficient or free | earthquake or wind: high damping coefficient or lock |
|---|---|---|---|
| deformed condition of building | FIG. 37 | FIG. 39 | FIG. 41 |
| condition of device | FIG. 38 | FIG. 40 | FIG. 42 |
| | — | Since the switch valve is almost opened, the piston moves without much resistance. | Since the switch valve is almost closed, the piston moves while it receives much resistance. |
| δ | — | large | small |
| Δl | — | large | small |
| T | — | long | short |
| N | 0 | small | large |
| remarks | — | The inside steel pipe is not so much effective, the stiffness is soft and the natural period becomes longer. | The inside steel pipe is sufficiently effective, the stiffness is hard and the natural period becomes shorter. |

δ: horizontal deformation (uppermost portion)
Δl: expansion and contraction of outer post
T: primary natural period of building
N: axial force of inside steel pipe As shown in FIGS. 37 and 38, when vibrational disturbances are slight, the building is not substantially deformed and the switch valve 135 of the cylinder lock device 130 does not need to be controlled.

FIGS. 39 and 40 show switch valves 135 fully opened or almost closed. In this case, the inside steel pipe 121 is not effective and the natural period becomes longer. The control under such a condition as noted above is carried out for a seismic tremor having a short predominant period. Also, when the control is carried out in consideration of the damping property, a large damping force is obtained for a great earthquake having a large vibration level by increasing the opening of the switch valve 135 of the cylinder lock device 130.

FIGS. 41 and 42 show the case where the switch valve 135 is fully closed or almost closed. In this case, the inside steel pipe 121 is sufficiently effective and the natural period becomes shorter. The control in such a condition as noted above is carried out for seismic tremor or strong wind having a long predominant period. Also, when the control is carried out in consideration of the damping property, a large damping force is obtained for medium and small earthquakes by reducing the opening of the switch valve 135 (the valve 135 is almost closed) of the cylinder lock device 130.

Numerous modifications and variations of the subject invention may occur to those skilled in the art upon a study of this disclosure. It is therefore to be understood that, within the scope of the appended claims, the invention may be practiced otherwise than as described in the specification and illustrated in the drawings.

What is claimed is:

1. In a building structure, means to control the response of the structure to external forces of seismic vibration and/or wind impacting against said structure, comprising: variable stiffness means secured to and bracing said structure; variable damping means having a variable coefficient of damping interposed between said structure and said variable stiffness means; and means to vary the coefficient of damping of said variable damping means responsive to the magnitude of said external forces impacting against said structure.

2. The means of claim 1, including computer means programmed to monitor external forces impacting against said structure and to control said variable damping means by selecting the coefficient of damping for said variable damping means best suited to control the response of said structure to said external forces and by actuating said variable damping means.

3. The means of claim 2 wherein said coefficient of damping is selected to render said structure non-resonant relative to the said monitored external forces.

4. The means of claim 1, wherein said variable damping means comprises: a double acting hydraulic cylinder; a shiftable piston in said hydraulic cylinder dividing said cylinder into two concentrically opposed chambers; a piston rod axially aligned and concentrically mounted in said piston to extend through said opposed chambers; means to secure one end of said piston rod to said structure; means to secure the other end of said rod to said variable stiffness means; first means to pass a hydraulic fluid from one chamber to the other chamber; valve means to control the flow of hydraulic fluid in said first means; and means to control said valve means, whereby the coefficient of damping of said variable damping means is determined by the control of said valve means.

5. The means of claim 4, including second means to pass a hydraulic fluid from one chamber to the other chamber; means to restrict the flow of hydraulic fluid in said second means; said second means comprising a bypass around said valve means in said first means.

6. The means of claim 1, wherein said variable damping means comprises: a hydraulic cylinder; a shiftable piston in said hydraulic cylinder dividing said cylinder into two opposed chambers; a piston rod axially aligned and concentrically mounted in said piston to extend through said opposed chambers; means to secure one end of said piston rod to said structure; means to secure the other end of said rod to said variable stiffness means; an oil pressure line with one end connected to one of said chambers and connected to the inflow side of a variable damping control valve; an oil pressure line connected at one end to the outflow side of said variable damping control valve and at its other end to the other of said chambers; means to open and to close said variable damping control valve wherein said piston is rendered immovable in said cylinder when said variable damping control valve is closed and movable in said cylinder when said variable damping control valve is open, whereby the coefficient of damping of the variable damping means is a first preselected value when said variable damping control valve is closed and a second preselected value when said variable damping control valve is open.

7. The means of claim 6, including means to actuate said means to open and to close said variable damping control valve.

8. The means of claim 6, wherein said means to actuate said means to open and to close said variable damping control valve is adapted to sense and to respond to sensed external forces of seismic vibration and/or wind impacting against said structure by controlling the opening and closing of said means to open and to close said variable damping control valve.

9. The means of claim 6, wherein said means to open and to close said variable damping control valve is adapted to pulse said variable damping control valve with pulses of variable time intervals to thereby provide a plurality of selectable coefficients of damping for said variable damping means.

10. The means of claim 9, wherein said means to actuate said means to open and to close said variable damping control valve comprises computer means adapted to sense, to measure, and to evaluate external forces of seismic vibration and/or wind impacting against said structure and to transmit signals to said means to open and to close said variable damping control valve to provide a coefficient of damping commensurate with the computer-sensed seismic and/or wind forces impacting against said structure.

11. The means of claim 1, wherein said variable stiffness means comprises cross braces secured between selected portions of said structure, and said variable damping means is secured between said cross braces and said structure.

12. The means of claim 1, wherein said structure comprises posts and beams, said variable stiffness means comprises cross braces secured between said posts and beams, and said variable damping means interconnects said cross braces, posts and beams.

13. The means of claim 12, wherein said cross braces are segmented and said variable damping means connects said segmented cross braces.

14. The means of claim 12, wherein said cross braces are of X-shaped configuration, and said variable damping means forms the center of each of said X-shaped cross braces.

15. The means of claim 12, including a quake-resisting wall secured to one of said beams and said variable damping means secured between another of said posts and said quake resisting wall.

16. The means of claim 12, wherein said cross braces comprise a pair of V-shaped members with the apex ends of said members positioned adjacent the midsection of a beam and the opposite ends of said members secured to the opposite ends of a vertically spaced apart beam, and said variable damping means secured between the apex ends of said members and said midsection of said adjacent beam.

17. The means of claim 12, including a U-shaped member secured to the underside of a beam and depending therefrom; a U-shaped member secured to the topside of a beam spaced vertically below said first-mentioned beam and projecting upwardly therefrom, and variable damping means interconnecting said U-shaped members.

18. The means of claim 12, including a structure foundation, resilient means interposed between said structure and said foundation, and variable damping means connected between said structure and said foundation.

19. The means of claim 1, wherein said structure comprises vertical hollow posts; variable stiffness means positioned within said posts; and variable damping means interconnecting said variable stiffness means and said vertical hollow posts.

20. The means of claim 19, wherein said variable stiffness means comprises steel pipe spaced away from the interior walls of said vertical hollow posts.

* * * * *